US011389988B2

(12) United States Patent
Skillicorn et al.

(10) Patent No.: US 11,389,988 B2
(45) Date of Patent: Jul. 19, 2022

(54) METHOD AND APPARATUS FOR CUTTING DADOES

(71) Applicant: Woodpeckers, LLC, Strongsville, OH (US)

(72) Inventors: Gregory L. Skillicorn, Granger Township, OH (US); Richard M. Hummel, Parma, OH (US)

(73) Assignee: Woodpeckers, LLC, Strongsville, OH (US)

( * ) Notice: Subject to any disclaimer, the term of this patent is extended or adjusted under 35 U.S.C. 154(b) by 419 days.

(21) Appl. No.: 16/525,863

(22) Filed: Jul. 30, 2019

(65) Prior Publication Data

US 2021/0031400 A1 Feb. 4, 2021

(51) Int. Cl.
*B27F 5/02* (2006.01)

(52) U.S. Cl.
CPC ..... *B27F 5/02* (2013.01)

(58) Field of Classification Search
CPC ..... B27F 1/00; B27F 1/02; B27F 1/04; B27F 1/06; B27F 1/08; B27F 1/10; B27F 1/12; B27F 1/16; B27F 5/00; B27F 5/02
See application file for complete search history.

(56) References Cited

U.S. PATENT DOCUMENTS

| | | | | | |
|---|---|---|---|---|---|
| 3,003,527 | A * | 10/1961 | Fortune | B27F 5/02 | 144/136.1 |
| 5,458,171 | A * | 10/1995 | Ward | B27F 1/08 | 144/144.1 |
| 5,494,089 | A * | 2/1996 | Lubbe | B23Q 9/0042 | 144/134.1 |
| 5,813,807 | A * | 9/1998 | Rogers | B23Q 9/0042 | 144/144.51 |
| 6,206,060 | B1 * | 3/2001 | Blake | B23D 47/04 | 144/135.2 |
| 2005/0236069 | A1 * | 10/2005 | O'Brien | B27M 3/12 | 144/144.1 |

OTHER PUBLICATIONS

Steve Scott, Dado Jig Tackles Shelves of Any Thickness, Jun. 2012, https://www.finewoodworking.com/project-guides/shop-projects/dado-jig-tackles-shelves-of-any-thickness (Year: 2012).*
WoodworkersJournal, Building a Classic Bookcase | Step-by-Step Project Video, Apr. 28, 2017, https://www.youtube.com/watch?v=51xGd_Eqsmw (Year: 2017).*

* cited by examiner

*Primary Examiner* — Matthew Katcoff
(74) *Attorney, Agent, or Firm* — Sand, Sebolt & Wernow Co., LPA

(57) ABSTRACT

A dado jig that may be adapted for use with any thickness of wood stock to allow quick and accurate cutting of dadoes to fit the thickness of the stock piece exactly is provided. The present disclosure further provides a method of use for a dado jig to cut both open and blind dadoes with stock of varying thicknesses without the need to measure that thickness.

17 Claims, 21 Drawing Sheets

METHOD AND APPARATUS FOR CUTTING DADOES

TECHNICAL FIELD

The present disclosure relates generally to the field of woodworking tools. More particularly, the present disclosure relates to a jig for cutting both open and blind dadoes. Specifically, the present disclosure relates to an adjustable jig for cutting dadoes allowing quick and repeatable dado cutting to the exact width needed without measurement.

BACKGROUND

Background Information

As used in woodworking, a dado is a rectangular crosscut made into a board or other workpiece to make a joint with a second board. Dadoes are commonly used to join two pieces of wood, such as shelves and shelving units or the like. In its most basic form, a dado is a cut into the face of one board to match the thickness and width of a second board which is then inserted into the dado in the first board on its edge.

Whether a result of imported wood, conversions between metric and imperial measurement systems, or variable dimension measurements across lumber brands, it is now commonplace that plywood and other sheet goods do not measure exactly to their nominal dimensions. Further, the actual dimensions of plywood and other sheet goods tend to vary widely across brands, sheet type, and country of origin. It is therefore common that two pieces of wood may be marked as having the same nominal dimensions, but may in fact have two different actual dimensional measurements. When using such wood stock in creating a workpiece, particularly those workpieces that are desired to have a fine finish and uniform appearance, it is difficult to cut dadoes that are a uniform fit given the variability of the measurements of the wood stock.

Current practices for cutting dadoes involve taking multiple measurements and making very detailed plans to account for varying thicknesses of each piece of stock being used. This is time-consuming and introduces significant opportunity for error to be made in that a measurement error of even a small fraction of an inch or a few millimeters can result in a dado that is too small to accept the second pieced of stock or alternatively is too big and includes slop and movement of the stock piece therein. Alternatively, in the past woodworkers have used undersized router bits to cut dado grooves in small increments across several passes and hoped that the groove is sized to fit the second board. In this instance, multiple passes are made and the woodworker attempts to err on the side of the dado being too small as more wood can always be removed from the dado to accommodate a thicker board. However, it is difficult to keep these cuts exact relative to the width of the stock, particularly when that width may not be uniform across all stock pieces being used.

SUMMARY

The present disclosure addresses these and other issues by providing a dado jig that may be adapted for use with any thickness of wood stock to allow quick and accurate cutting of dadoes to fit the thickness of the stock piece exactly. The present disclosure further provides a method of use for a dado jig to cut both open and blind dadoes with stock of varying thicknesses without the need to measure that thickness.

In one aspect, an exemplary embodiment of the present disclosure may provide a jig for cutting dadoes comprising: a first rail having a first end orthogonally fixed to a first end plate and a second end longitudinally spaced apart from the first end and defining the longitudinal length of the first rail therebetween; a second rail having a first end movably connected to the first end plate and a second end longitudinally spaced apart from the first end and defining the longitudinal length of the second rail therebetween, the second rail being movable relative to the first rail in a transverse direction orthogonal to longitudinal length of the first and second rails; a second end plate moveably connected to the second end of the first rail and the second end of the second rail, the second end plate being movable relative to the first end plate along the longitudinal length of the first and second rails; a first edge guide connected to the first rail; and a second edge guide connected to the second rail, the first and second edge guides operable to guide a router bit for cutting a dado in a workpiece.

In another aspect, an exemplary embodiment of the present disclosure may provide a method of cutting dadoes comprising: aligning a first end plate of a dado jig against a first end of a first board and securing the first end plate thereto; aligning a second end plate of the dado jig against a second end of the first board longitudinally opposite the first end plate and securing the second end plate thereto; positioning a second board orthogonal to the first board with a side of the second board between a first rail extending longitudinally between the first end plate and the second end plate of the dado jig and a second rail extending longitudinally between the first end plate and the second end plate of the dado jig; moving the second rail transversely relative to the first rail to contact a first face of the second board with the first rail and a second face of the second board with the second rail; securing the second rail in position relative to the first rail; removing the second board from between the first and second rails; cutting a dado in the first board between the first and second rails of the dado jig.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
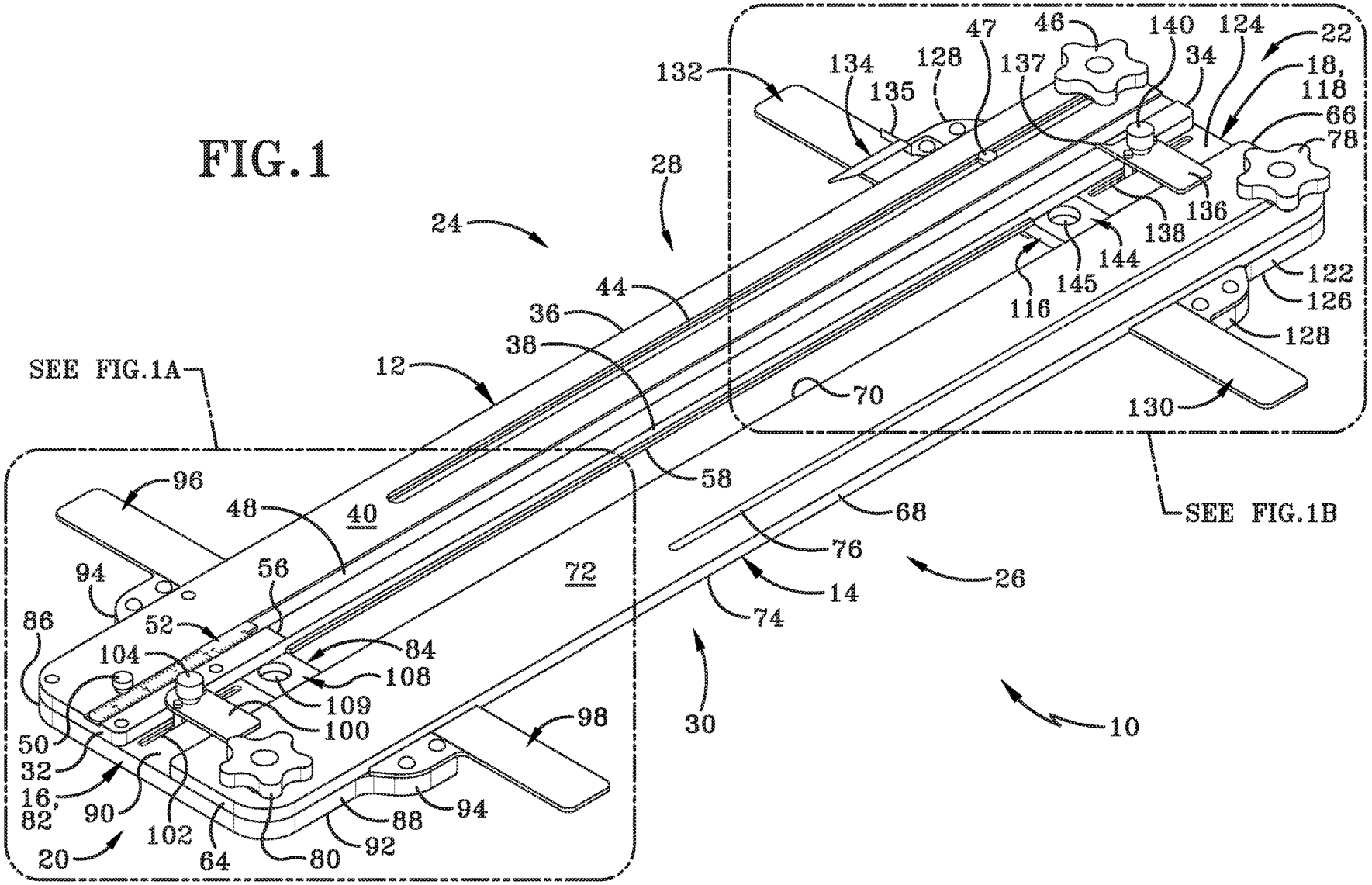
FIG. 1 (FIG. 1) is a top left perspective view of a dado jig according to one aspect of the present disclosure.
Figure 1A:
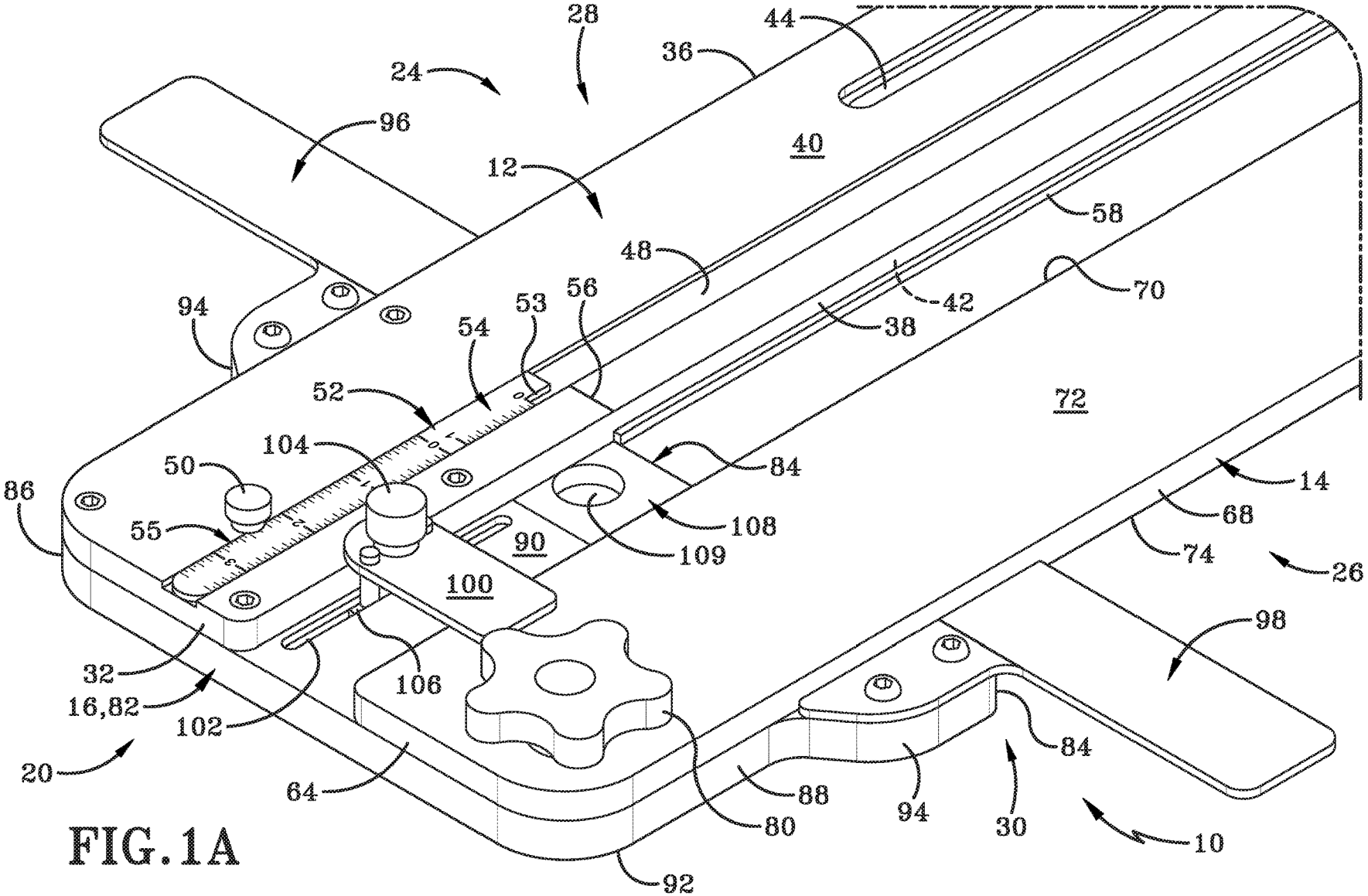
FIG. 1A (FIG. 1A) is a close up perspective view of the area identified in FIG. 1 according to one aspect of the present disclosure.
Figure 2A:
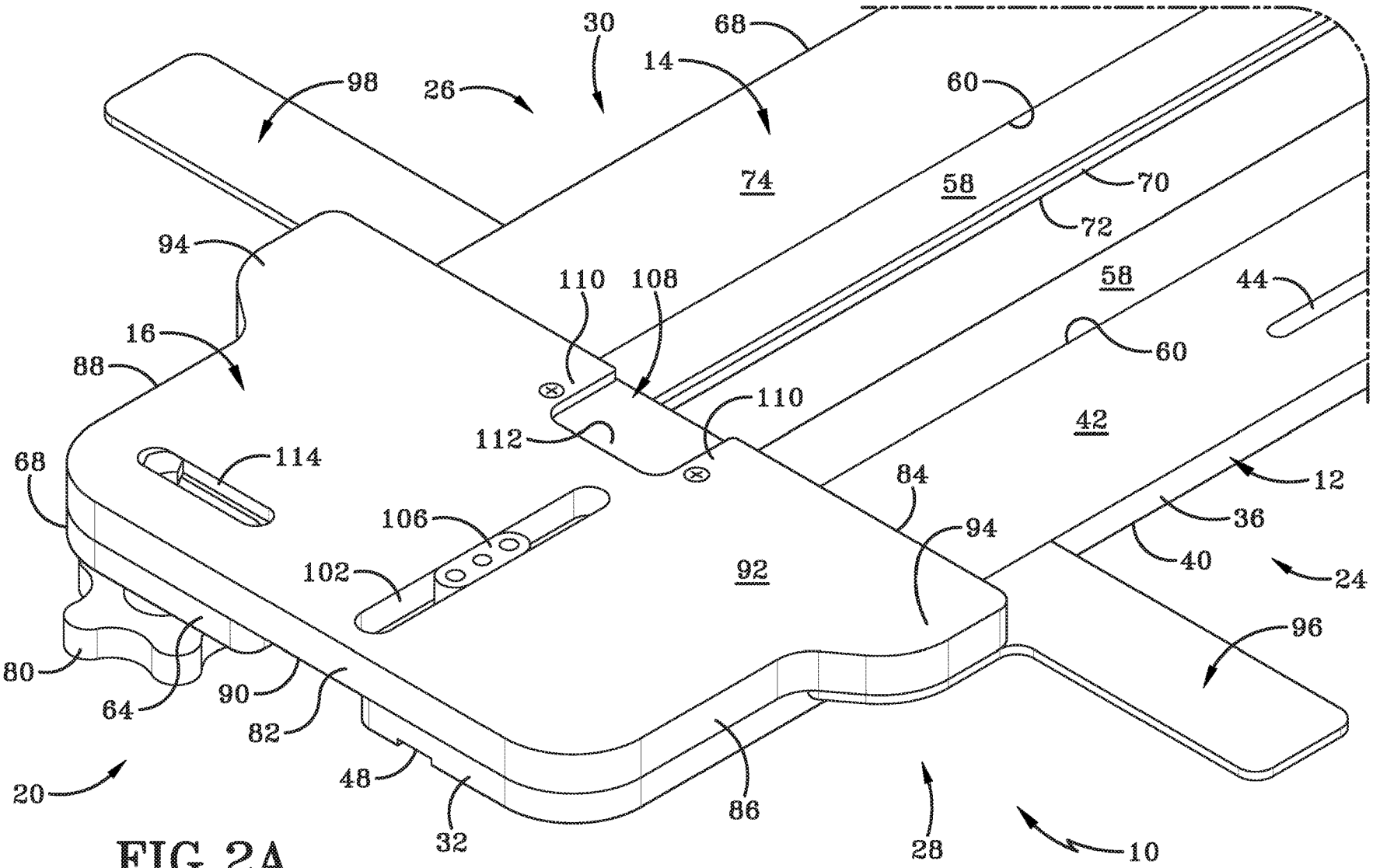
FIG. 2A (FIG. 2A) is a bottom left perspective view of the area from FIG. 1A according to one aspect of the present disclosure.
Figure 2B:
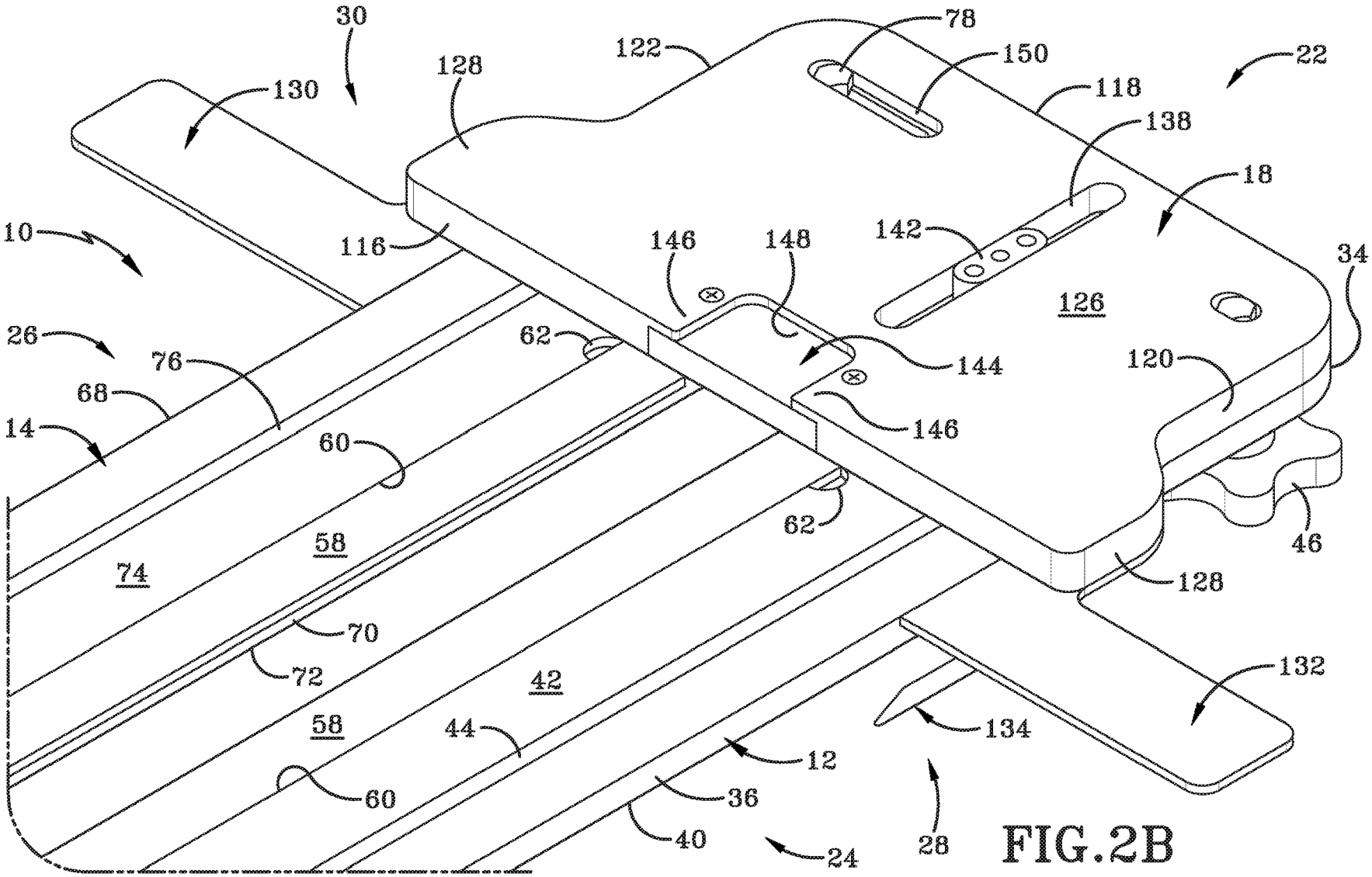
FIG. 2B (FIG. 2B) is a bottom left perspective view of the area from FIG. 1B according to one aspect of the present disclosure.
Figure 3:
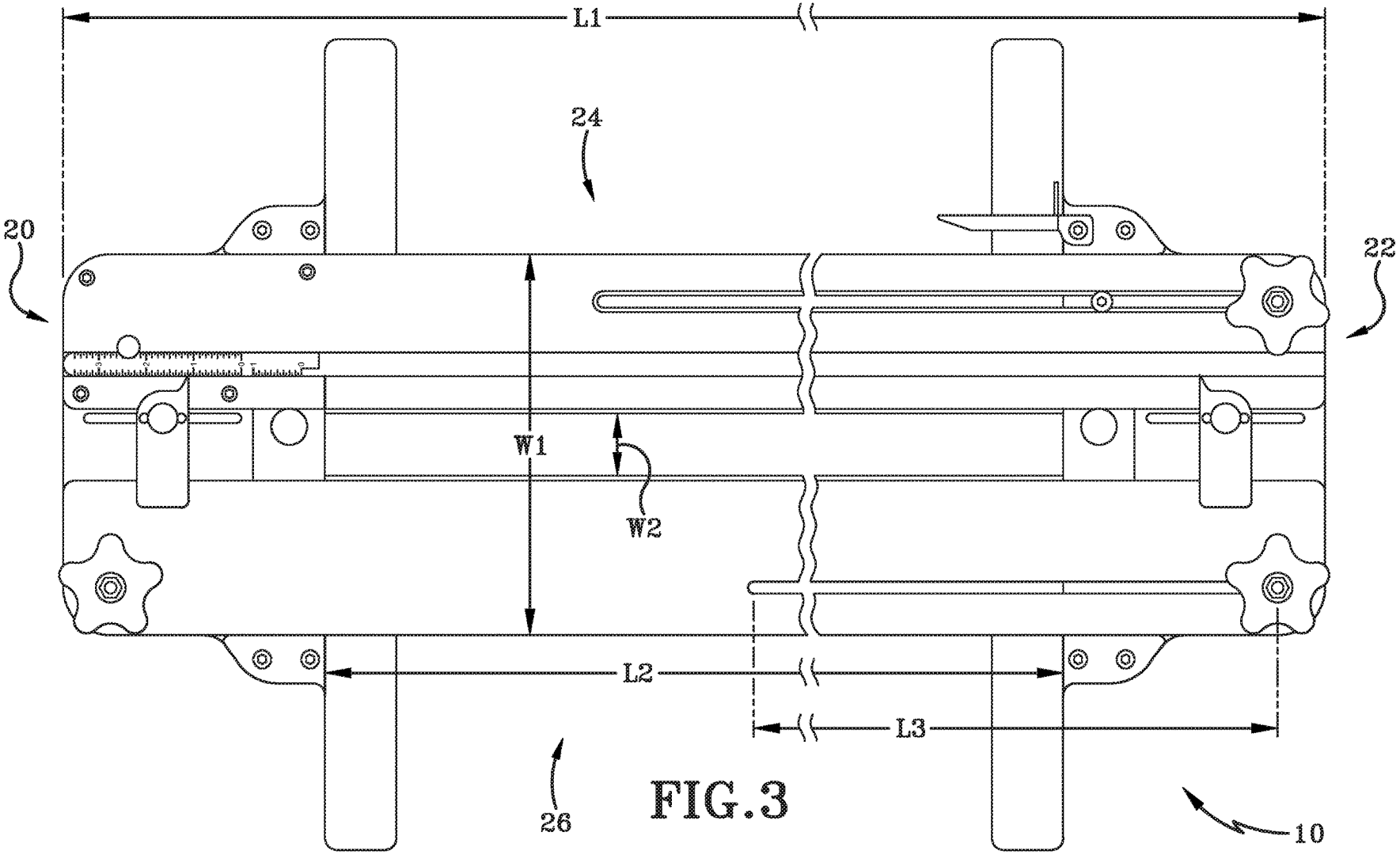
FIG. 3 (FIG. 3) is a top plan view of a dado jig showing dimensions thereof according to one aspect of the present disclosure.

With reference to FIGS. 1-3, an exact width dado jig is shown and generally indicated at 10 and hereinafter referred to as jig 10 or dado jig 10. Jig 10 may have a first rail 12, a second rail 14, a first end plate 16, and a second end plate 18. Jig 10 may have a first end 20 spaced apart from a second end 22 and defining a longitudinal direction therebetween. Jig 10 may also have a first side 24 spaced apart from a second side 26 and defining a transverse or horizontal direction therebetween. Jig 10 may have a top side 28 spaced apart from a bottom side 30 and defining a vertical direction therebetween. Generally speaking, top side 28 of jig 10 is the side facing upwards while jig 10 is in use and bottom side 30 is the side facing downwards and sitting on a face of a board when jig 10 is in use, as described further herein.

First rail 12 may have a first end 32 spaced apart from a second end 34 in the longitudinal direction. According to one aspect, first end 32 may coincide with and/or define first end 20 of jig 10, while second end 34 of first rail 12 may coincide with and/or define second end 22 of jig 10. First rail 12 may also have an outer side 36 which may be transversely spaced apart from an inner side 38. Outer side 36 may be the side of first rail 12 facing away from second rail 14 while inner side 38 may be the side of rail 12 facing towards second rail 14. First rail 12 may further include a top surface 40 generally oriented towards top side 28 of jig 10 and a bottom surface 42 generally oriented towards the bottom side 30 of jig 10.

First rail 12 may have a first longitudinal adjustment slot 44 defined therein for longitudinal adjustments of jig 10 as described further below. First longitudinal adjustment slot 44 may include a longitudinal adjustment knob 46 and an alignment screw 47. First longitudinal adjustment slot 44 may extend along a portion of first rail 12 from nearby second end 34 towards first end 32.

First rail 12 may further include a ruler channel 48 containing a sliding ruler 52 therein. Ruler channel 48 may contain ruler 52 via a ruler thumb screw 50 that may be tightened or loosened as desired to prevent ruler 52 from being removed from ruler channel 48 accidentally. Ruler channel 48 may be a groove or depression integrally formed into first rail 12 and extending the longitudinal length thereof.

Ruler 52 may be removable from ruler channel 48 and may include an offset notch 53 and an offset scale 54 for use in setting the appropriate depth of a router bit 170, as discussed below. Ruler 52 may also include a second scale 55 for use in setting the position of stop members 100 and 136 when cutting a blind dado 206, also discussed further below.

First rail 12 may have a reference line 56 marked on the top surface 40 adjacent to ruler channel 48 and precision aligned with the second end 84 of first end plate 16 as discussed further below. According to one aspect, reference line 56 may be painted or otherwise applied, such as through a sticker or the like, to top surface 48, 40 of first rail 12. According to another aspect, reference line 56 may be etched, scored, or the like into top surface 40 of first rail 12.

First rail 12 may further include an edge guide 58 which may be mounted to an edge guide mounting flange 60 formed in the bottom surface 42 of first rail 12. Edge guide 58 may be a removable and replaceable component that is adhered to bottom side 42 of first rail 12 via adhesive, magnets, or any other temporary connection. According to another aspect, edge guide 58 may be more permanently affixed to bottom surface 42 of rail 12. According to another aspect, edge guide 58 may be a flexible material and may include one or more features to allow it to grip the edge guide mounting flange 60 to keep it secure against bottom surface 42 of first rail 12. Edge guides 58 may be constructed of plastic, rubber, or other synthetic materials that may be utilized to insure dadoes are cut to the appropriate position as discussed further herein. Bottom surface 42 may have an edge guide removal notch 62 defined therein (best seen in FIG. 2B) which may facilitate the removal and replacement of edge guide 58 as necessary.

Second rail 14 may likewise include a first end 64 generally corresponding to first end 20 of jig 10 and a second end 66 generally corresponding to second end 22 of jig 10. First end 64 and second end 66 of second rail 14 may be spaced apart along the longitudinal direction. Second rail 14 may further include an outer side 68 and an inner side 70. As with first rail 12, outer side 68 of second rail 14 may be the side facing away from first rail 12 while inner side 70 of second rail 14 may be the side facing towards first rail 12 when jig 10 is installed and in use. Second rail 14 may have a top surface 72 generally oriented to the top side 28 of jig 10 and a bottom surface 74 generally oriented to the bottom side 30 of jig 10.

Second rail 14 may have a second longitudinal adjustment slot 76 defined therein with a two-way adjustment knob 78 installed therethrough. Two-way adjustment knob 78 may be utilized in both longitudinal and horizontal (transverse) adjustments of jig 10 as discussed further herein. Similar to longitudinal adjustment knob 46, two-way adjustment knob 78 may be generally located towards second end 66 of second rail 14. Second longitudinal adjustment slot 76 may extend from nearby second end 66 of second rail 14 generally towards first end 64 of second rail 14. Second rail 14 may further include a horizontal adjustment knob 80 generally located at or near first end 64 of second rail 14.

First and second rails 12, 14 may be constructed of any suitable material. According to one aspect, rails 12, 14 may be formed of phenolic which is a slick, hard, synthetic material with a long-life span that is highly durable and resistant to cuts and abrasions that may occur over the life of jig 10. According to another aspect, rails 12, 14 may be made of any suitable material including, but not limited to, metals such as steel or aluminum or high density, high durability synthetic materials such as plastics or resins. First and second rails 12, 14 may be formed using any suitable manufacturing method, including extrusion, milling, induction molding, or the like.

The operation and adjustments of rails 12 and 14 of jig 10, utilizing first and second longitudinal adjustment slots 44, 76, longitudinal adjustment knob 46, two-way knob 78, and/or horizontal adjustment knob 80, will be discussed further below with reference to the operation and use of jig 10.

With continued reference to FIGS. 1-3, but with particular reference to FIGS. 1A through 2B, first and second end plates 20, 22 will now be described. First end plate 16 may include a first end 82 generally corresponding to first end 20 of jig 10 spaced longitudinally apart from a second end 84. First end 82 may be oriented towards first end 20 of jig 10 while second end 84 may be oriented towards second end 22 of jig 10. Second end 84 may define a planar surface (along with clearance block 108) that may abut an end of a piece of wood when jig 10 is in operation, as discussed below. First end plate 16 may also have a first side 86 generally oriented towards first side 24 of jig 10 spaced horizontally or transversely apart from second side 88 which may be generally oriented towards second side 26 of jig 10. First end plate 16 may have a top surface 90 which may be oriented towards top side 28 of jig 10 and spaced vertically apart from a bottom surface 92 which may be oriented towards bottom side 30 of jig 10. First end plate 16 may be generally rectangular in shape with a pair of symmetrical and opposing mounting regions 94 on the first and second sides 86, 88 thereof. Mounting regions 94 may be projections extending transversely from each side 86, 88 of first end plate 16 for operational engagement with a first clamping pad 96 and a second clamping pad 98.

First end plate 16 may include a first stop member 100 having a stop member pointer 101 formed thereon. First stop member 100 may be disposed within a stop member adjustment slot 102 defined through first end plate 16 and held in place therein with stop member thumb screw 104. First stop member 100 may have an elongated lower portion 106 configured to sit within stop member adjustment slot 102 to allow adjustment of stop member 100 longitudinally along the length of stop member adjustment slot 102, as discussed below. First member 100 may extend over and above first and second rails 12, 14 such that first stop member 100 may lay adjacent to and in contact with top surfaces 40, 72 of first and second rails 12, 14. Stop member pointer 101 may be a projection extending from stop member 100 to provide a visual reference on ruler 52, as discussed below. Stop member adjustment slot 1302 may extend longitudinally between first and second ends 82, 84 of first end plate 16.

First end plate 16 may further include a first clearance block 108 which may be removeably connected to a first clearance block mount 110. First clearance block 108 may be a small block of wood or other suitable material that may abut the edge of a board in which a dado is to be cut to prevent splintering and/or tear-out of the wood, as discussed below. First clearance block 108 may have a clearance hole 109 defined therein that may extend a partial distance through first clearance block 108.

The bottom surface 92 of first end plate 16 may include a first clearance block opening 112 which may be a recess or other feature defined within the bottom surface 92 of first end plate 16 to prevent damage to first end plate 16 by a router bit 170 that is set too deep when jig 10 is being used, as discussed below. According to one aspect, first clearance block 108 may be operationally connected to first clearance block mount 110 via screws (as shown), bolts, clips, adhesive, or any other suitable attachment means.

First end plate 16 may include a first horizontal adjustment slot 114 defined therethrough to accept the horizontal adjustment knob 80 to further facilitate horizontal or transverse adjustments of second rail 14 relative to first rail 12 as discussed further in the operation section below.

First end plate 16 may be generally located at first end 20 of jig 10 and may be operationally connected to first and second rails 12, 14 and first and second clamping pads 96, 98 through various connection means, including screws, bolts, rivets, clips, adhesives, or the like. Where the relationship between first end plate 16 and other components includes a movable connection (e.g. second rail 14 or first stop member 100), the connections may be accomplished through horizontal adjustment knob 80 and/or stop member 100 and stop member thumbscrew 104.

First rail 12 may be fixed relative to first end plate 16 and may be connected thereto with bottom surface 42 of first rail 12 adjacent to, and in contact with, top surface 90 of first end plate 16. First rail 12 may be fixedly attached thereto using screws, bolts, clips, adhesives, or the like. It is contemplated that first end 32 of first rail 12 will be aligned and flush with first end 82 of first end plate 16 and fixed relative thereto.

This fixed attachment may align first rail 12 orthogonal to first end plate 16 and may serve as a 90° fence to further facilitate the operation of jig 10, as discussed further below.

Second rail 14 may be likewise connected to first end plate 16 at the first ends 32, 82, respectively, thereof; however, second rail 14 may be moveable relative to first end plate 16 via first horizontal adjustment slot 114 and horizontal adjustment knob 80. Specifically, the first end 64 of second rail 14 may be flush with first end 82 of first end plate 16 but may move in a transverse direction relative thereto to accommodate wood stock of varying widths, as discussed further herein.

First clamping pad 96 and second clamping pad 98 may be fixedly connected to mounting regions 94 of first end plate 16 via bolts, screws, clips, adhesive, or other suitable connection methods. First and second clamping pads 96, 98 may be utilized to temporarily fix first end 20 of jig 10 to a workpiece to prevent movement thereof while jig 10 is being used as discussed below. First and second clamping pads 96, 98 may be formed of any suitable solid material, such as stainless steel, aluminum, anodized aluminum, phenolic, or the like.

Second end plate 18 may be substantially similar to first end plate 16 in shape and configuration with the exception that it may be oriented such that it is the mirror image of first end plate 16. Specifically, second end plate 18 may have a first end 116 spaced longitudinally apart from the second end 118. First end 116 may be the end oriented towards first end 20 of jig 10 and may define a planar surface (along with second clearance block 144) which may abut a second end of a piece of wood when jig 10 is in use, as discussed below. Second end 118 of second end plate 18 may be oriented towards second end 22 of jig 10. Second end plate 18 may also include a first side 120 generally oriented towards first side 24 of jig 10 spaced transversely apart from a second side 122 which may be generally oriented towards second side 26 of jig 10. Second end plate 18 may have a top surface 124 spaced vertically apart from a bottom surface 126 with top surface oriented towards top side 28 of jig 10 and bottom surface 126 oriented towards bottom side 30 of jig 10.

Second end plate 18 may have mounting portions 128 which may be substantially similar to mounting portions 94 of first end plate 16. Specifically, mounting portions 128 may extend transversely outward from first and second sides 120, 122 and may provide mounting points for third clamping pad 130 and fourth clamping pad 132. As with first and second clamping pads 96, 98, third and fourth clamping pads 130, 132 may be any suitable material that may be mounted to or otherwise attached to mounting region 128 via screws, bolts, rivets, adhesives, clamps, or any other suitable attachment method.

First through fourth clamping pads 96, 98, 130, 132 may be mounted to mounting regions 94, 128 in such a configuration to provide a flush transition and surface across the underside of clamping pads 96, 98, 130, 132 with the bottom surfaces 42, 74 of first and second rails 12, 14 to maintain a flat and uniform surface that may abut a face of a workpiece.

Figure 1B:
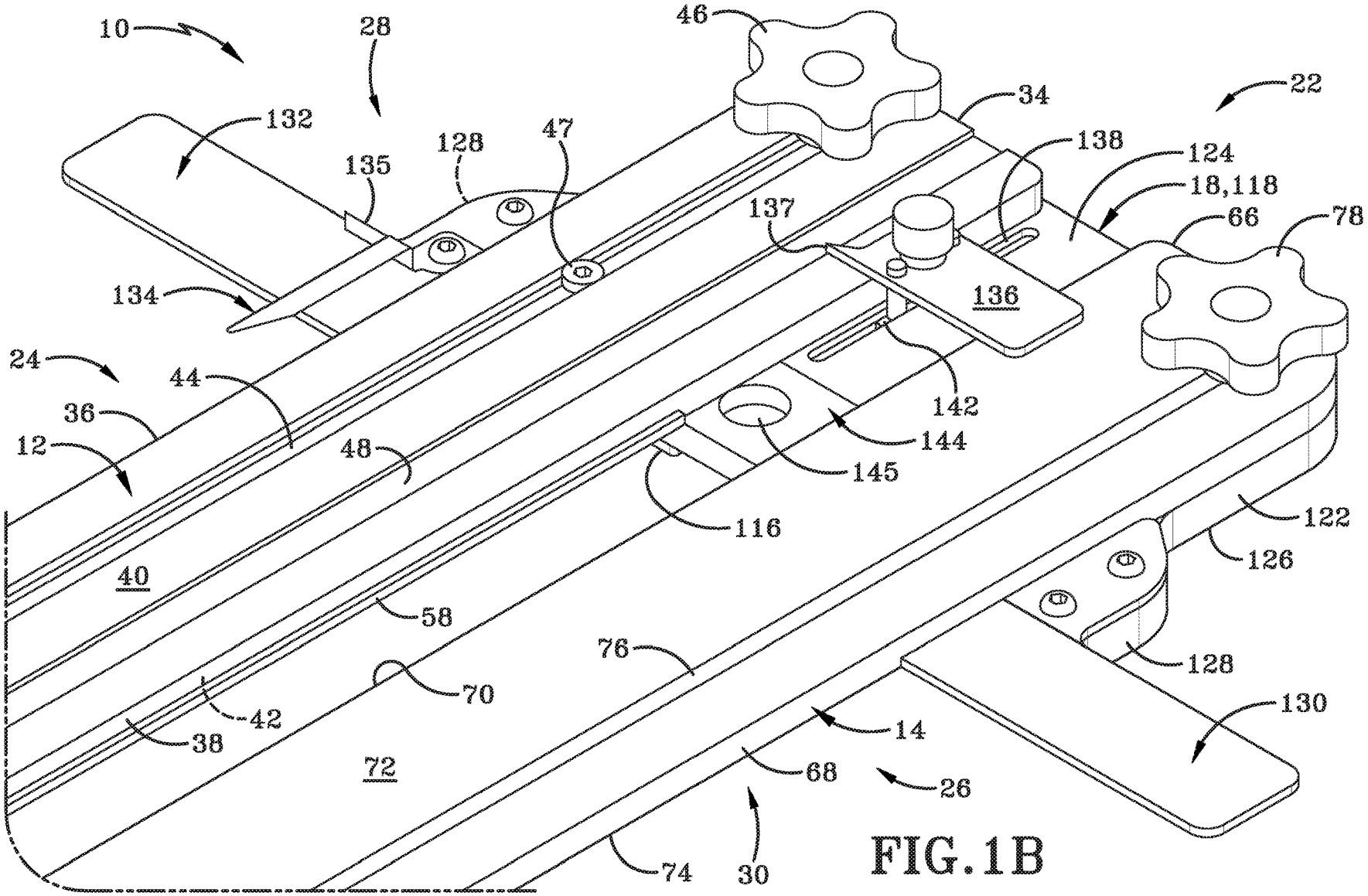
FIG. 1B (FIG. 1B) is a close up perspective view of the area identified in FIG. 1 according to one aspect of the present disclosure.
Figure 17:
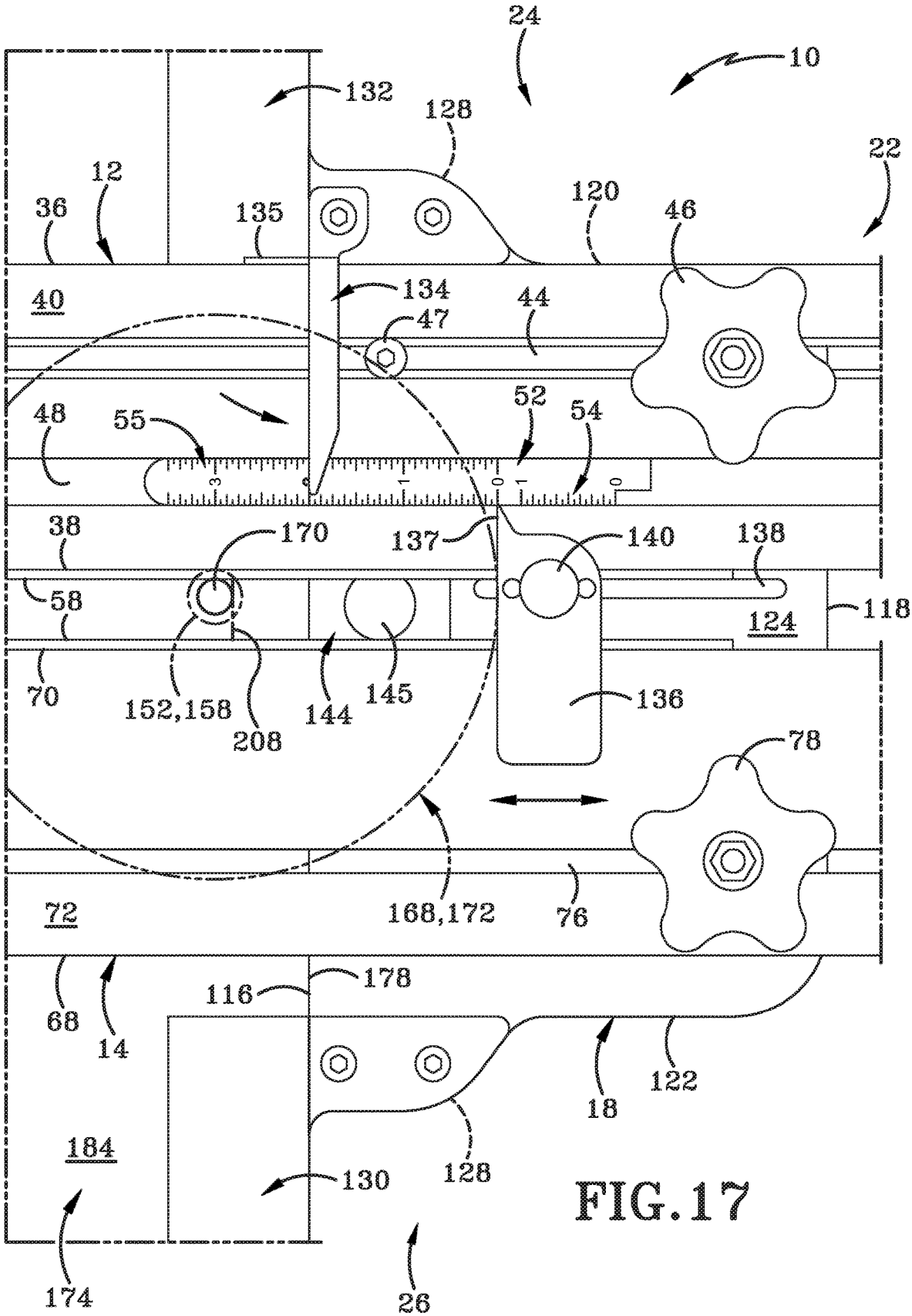
FIG. 17 (FIG. 17) is a top plan operational view of a second end of a dado jig according to one aspect of the present disclosure.

The mounting region 128 disposed on first side 120 of second end plate 18 may further support a pivoting reference marker 134. Pivoting reference marker 134 may be pivotably mounted to mounting region 128 on first side 120 of second end plate 18 and may pivot between a first position (as best illustrated and seen in FIG. 1B) wherein the marker is adjacent to first rail 12 and a second position (as best seen in FIG. 17) wherein the marker extends over and across top surface 40 of rail 12. Pivoting reference member 134 may be vertically offset to provide clearance over the side of first rail 12 and to facilitate the rotation across the top surface 40 thereof. Pivoting reference marker 134 may serve a substantially similar function to reference line 56 as discussed below; however, pivoting reference marker 134 may be in a fixed mounted position relative to second end plate 18 rather than fixed relative to first rail 12 to maintain the proper alignment of pivoting reference marker 134 with first end 116 of second end plate 18, as discussed further below. Pivoting reference marker 134 may include a stop arm 135 that may be orthogonal to pivoting reference marker 134 and may interact with outer side 36 of first rail 12 to prevent pivoting reference marker 134 from over-rotation.

Second end plate 18 may further include a second stop member 136 having a stop member pointer 137. Second stop member 136 may be substantially similar to first stop member 100 in that it may be a mirror image thereof. Accordingly, second stop member 136 may also have an elongated lower portion 142 mounted within a stop member adjustment slot 138 defined in second end plate 18. Second stop member 136 may further include a stop member thumb screw 140 to secure second stop member 136 in position. Second stop member 136 may likewise extend over and above first and second rails 12, 14 such that second stop member 136 may lay adjacent to and in contact with top surfaces 40, 72 of first and second rails 12, 14. Stop member pointer 137 may be a projection extending from stop member 136 to provide a visual reference on ruler 52, as discussed below. Stop member adjustment slot 138 may extend longitudinally between first and second ends 116, 118 of second end plate 18.

Second end plate 18 may also include a second clearance block 144 which may be removeably connected to a second clearance block mount 146. Second clearance block 144, similar to first clearance block 108, may be a small block of wood or other suitable material that may abut the edge of a board in which a dado is to be cut to prevent splintering and/or tear-out of the wood, as discussed below. Second clearance block 144 may have a clearance hole 145 defined therein that may extend a partial distance through second clearance block 144. According to one aspect, first and second clearance blocks 108, 144 may be interchangeable.

Bottom surface 126 of second end plate 18 may further have a second clearance block opening 148 defined therein to prevent damage to second end plate 18 by a router bit 170 that is set too deep when jig 10 is being used, as discussed below. As with first clearance block 108, second clearance block 144 may be removeably mounted to second clearance block mount 146 via screws (as shown), pins, bolts, adhesives, or the like.

Second end plate 18 may further include a second horizontal adjustment slot 150 defined therethrough through which two-way adjustment knob 78 may be secured, as discussed below.

Second end plate 18 may be generally positioned towards second end 22 of jig 10. However, it may be longitudinally moveable between a position where second end 118 of second end plate 18 is substantially flush with second end 34 of first rail 12 and second end 66 of second rail 14, and a plurality of positions along first and second longitudinal adjustment slots 44, 76. The movements and adjustments of second end plate 18 and various other components are discussed further below with regards to the operation and use of jig 10. Second end plate 18, as with first end plate 16, may be positioned such that top surface 124 of second end plate 18 may be adjacent to and in contact with bottom surfaces 42, 74 of first and second rails 12, 14, respectively, and may be operationally connected thereto by longitudinal adjustment knob 46, two-way knob 78, and/or stop member 136 and stop member thumbscrew 140.

First and second end plates 16, 18 may be formed from any suitable rigid material including, but not limited to, metal or synthetic material including, but not limited to, steel, stainless steel, aluminum, phenolic, or the like. According to one aspect, first and second end plates 16, 18 may be formed from anodized aluminum. As with first and second rails 12, 14, first and second end plates 16, 18 may be formed through any suitable manufacturing method including, but not limited to, extrusion, molding, and/or milling methods.

With reference to FIG. 3, the top plan view of jig 10 is shown with reference numerals removed for clarity apart from the numerals indicating first end 20, second end 22, first side 24, and second side 28 for orientation purposes. As depicted therein, jig 10 may have an overall length L1 corresponding to the longitudinal distance between first end 20 and second end 22. More particularly, length L1 represents the total longitudinal length of first and second rails 12, 14 and may define the maximum longitudinal length of jig 10. Length L2 represents the distance between second end 84 of first end plate 16 and first end 116 of second end plate 18. This distance L2 may vary as second end plate 18 is adjusted along first and second longitudinal adjustment slots 44, 76 as discussed further herein. Specifically, second end plate 18 may be adjusted longitudinally relative to first and second rails 12, 14 such that distance L2 may be at a maximum as depicted in FIG. 3 when second end 118 of second end plate 18 is even with the second ends 34 and 66 of first and second rails 12, 14. Length L2 may be at a minimum when second end plate 18 is adjusted along the longitudinal adjustment slots 44, 76 to a point that the alignment screw 47 and the two-way adjustment knob 78 contact the opposite ends of the longitudinal adjustment slots 44, 76 closest to first end 20 of jig 10, respectively.

As seen in the figures, first longitudinal adjustment slot 44 may be longer than second longitudinal adjustment slot 76 by a distance equal to the distance between alignment screw 47 and longitudinal adjustment knob 46. The extra length of first longitudinal adjustment slot 44 may account for this distance to keep second end plate 18 square to the workpiece as discussed further below. According to one aspect, length L2 may then define the minimum and maximum lengths of dadoes that may be cut utilizing jig 10. As longitudinal adjustment slots 44, 76 have no predetermined stops, length L2 may occupy any specific distance between a that minimum and maximum range. According to one aspect, the minimum length of L2 may be approximately five inches which the maximum may be approximate 24½ inches and length L2 may be therefore any specific length within that range. According to another aspect, jig 10 may be constructed and sized to allow for range in which length L2 may be larger or smaller as desired.

With continued reference to FIG. 3, the overall width of jig 10 may be indicated as W1 and may exclude first through fourth clamping pads, 96, 98, 130, 132 and mounting regions 94, 128. Thus width W1 may represent the transverse distance between first and second sides 86, 88 of first end plate 16 and first and second sides 120, 122 of second end plate 18. With first rail 12 fixedly attached to first end plate 16, the junction therebetween may remain constant allowing for second rail 14 to be transversely or horizontally adjusted to account for wood stock of varying widths to be utilized to produce dadoes of varying widths equal to the width of the wood stock, as discussed below. The width range of the dado is therefore represented as width W2 and may be the distance between edge guides 58 disposed on the bottom surfaces 42, 74 of first and second rails 12, 14. Specifically, second rail 14 may move horizontally relative to first rail 12 and first and second end plates 16, 18 via operation of two-way knob 78 and horizontal adjustment knob 80 in first and second horizontal adjustment slots 114, 150. As second rail 14 moves, the edge guide 58 disposed thereon may also move horizontally relative to the edge guide 58 disposed on first rail 12. Width W2 therefore may be any width between a maximum width wherein two-way knob 78 and horizontal adjustment knob 80 contact the ends of horizontal adjustment slots 114, 150 closest to second side 26 of jig 10 and a minimum width wherein two-way knob 78 and horizontal adjustment knob 80 contact ends of horizontal adjustment slots 114, 150 closest to first side 24 of jig 10. At the maximum width, outer side 68 of second rail 14 is aligned and flush with second sides 88, 122 of first and second end plates 16, 18, respectively. According to one aspect, the minimum width W2 is be equal to or greater than the diameter of a router bit 170 (once edge guides 58 have been trimmed appropriately, discussed below) as the router bit 170 must able to extend through jig 10 in order to cut an associated dado in workpiece as discussed below. According to one aspect, this minimum width W2 may be ⅜ inch while the maximum width may be 1½ inches. According to another aspect, jig 10 may be configured and constructed such that the range in which width W2 may fall may be larger or smaller than the range provided herein.

Figure 4:
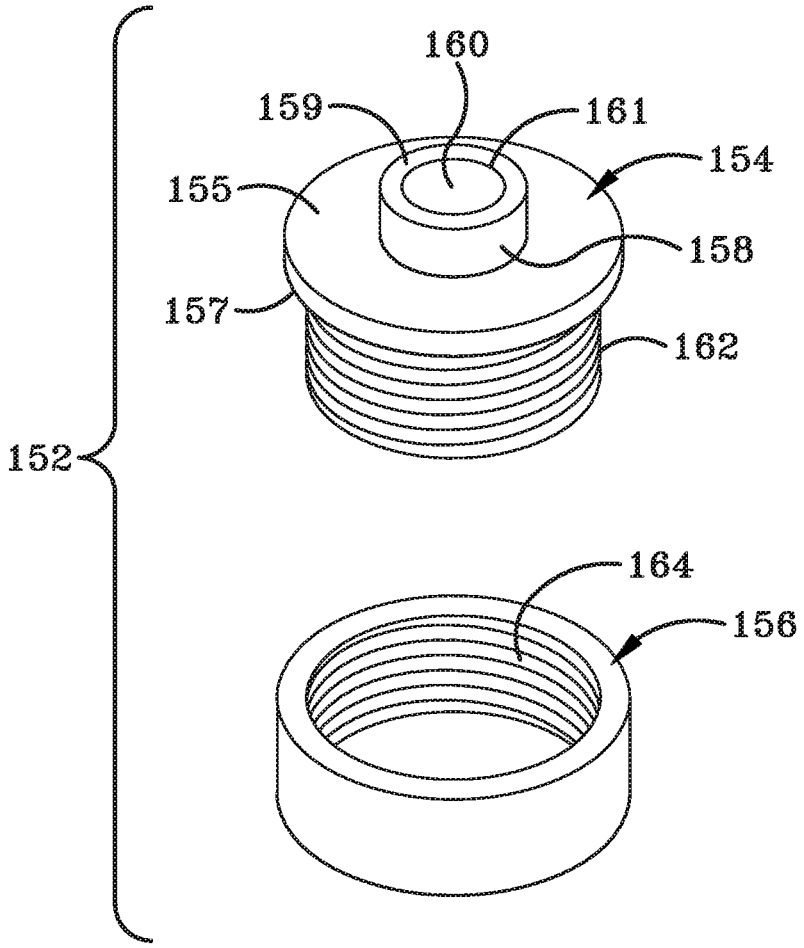
FIG. 4 (FIG. 4) is an exploded view of a guide bushing for use with a dado jig according to one aspect of the present disclosure.
Figure 5:
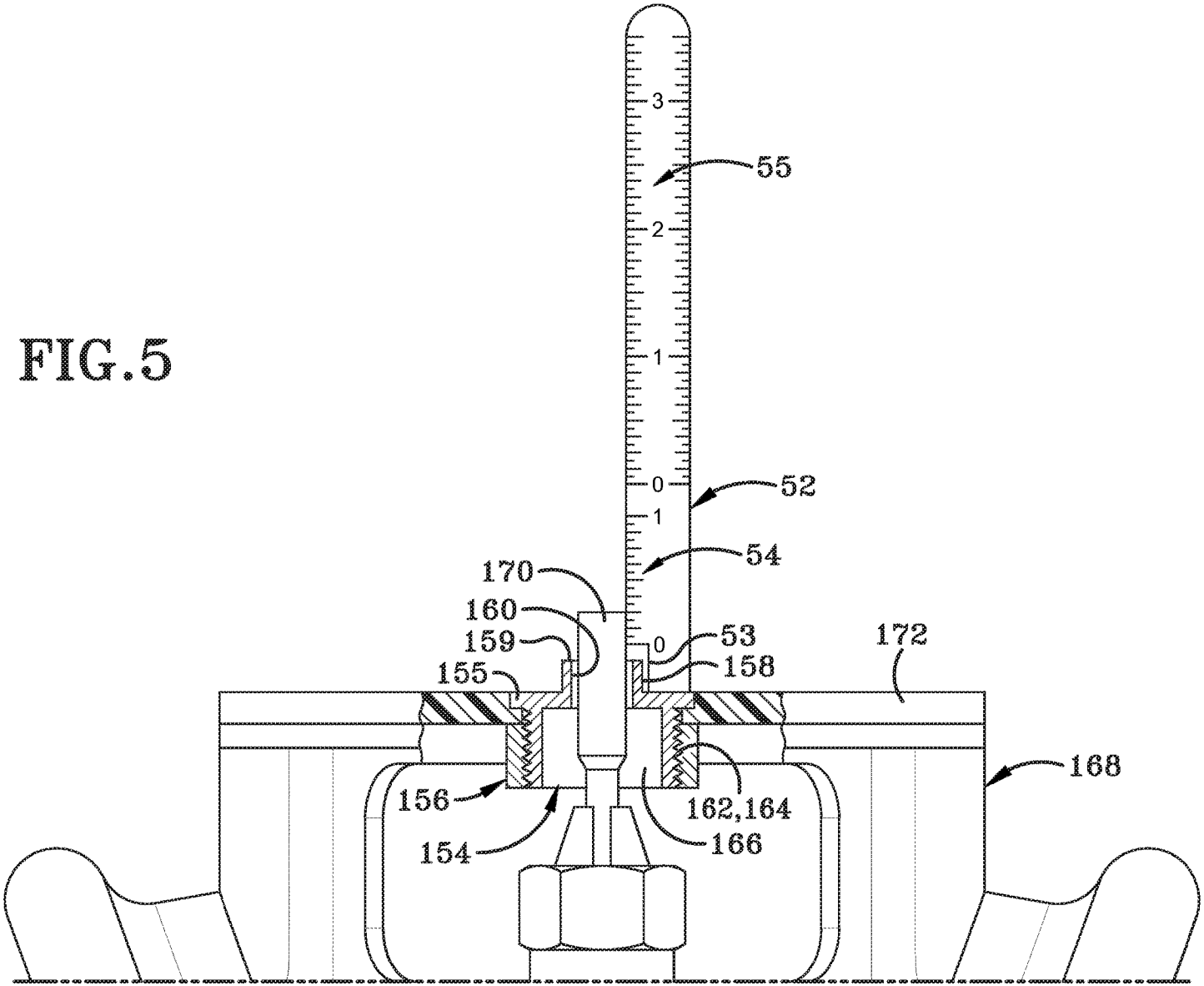
FIG. 5 (FIG. 5) is a side elevation view of a router and guide bushing with the router and guide bushing rendered in a partial cross-section according to one aspect of the present disclosure.

With reference now to FIGS. 4-5, a guide bushing 152 may be utilized with a router 168 (best seen in FIG. 5) to facilitate proper positioning router 168 within jig 10 while cutting a dado. Guide bushing 152 may be a two-piece bushing having a bushing adaptor 154 and a bushing collar 156. Bushing adaptor 154 may include an adaptor ring 155 which extends outwardly beyond external threads 162 thereon to create a lip 157. Adaptor ring 155 may have a diameter equal to the outer diameter of bushing collar 156. Bushing adaptor 154 may include a spacer ring 158 having an end surface 159 opposite the joint between the spacer ring 158 and the adapter ring 155. End surface 159 may have an inner edge 160 that may be adjacent to router bit 170 when installed on a router 168. Bushing adaptor 154 may have a through opening 160 that extends through the interior of spacer ring 158 and into the interior 166 of bushing adaptor 154. This through opening may allow a router bit 170 to extend therethrough when guide bushing 152 is installed on the router 168. Bushing adaptor 154 may include external threads surrounding the interior 166 while bushing collar 156 may include internal threads 164 and may be sized so that bushing collar 156 may fit over the threaded portion 162 of bushing adaptor 154. Guide bushing 152 may be installed on a router 168 with bushing adaptor 154 on an outside or an outer portion of a router fence 172 while bushing collar 152 may be threadedly engaged with external threads 162 of bushing adaptor 154 to secure guide bushing 152 in place on opposite sides of router fence 172 as seen in FIG. 5. Router bit 170 may be inserted through the through opening 160 in bushing adaptor 154 for operational engagement with the router 168.

Guide bushing 152, or more specifically, space ring 158, may ride along the inner sides 38, 70 of first and second rails 12, 14 when cutting a dado and may also be utilized in preparing the edge guides 58 for use with dado jig 10, as discussed below.

As further seen in FIG. 5, offset notch 53 of ruler 52 may be sized to be equal to the vertical thickness of rails 12, 14 with edge guides 58 installed to properly set the depth of the router bit 170. Therefore, the offset notch 53 defines the beginning of the offset scale 54 starting at zero and extends up from the top of offset notch 53 so that the router depth may be appropriately set accounting for the thickness of jig 10. According to the example seen in FIG. 5, a router depth of ¼ inch is shown wherein the tip of the router bit 170 terminates ¼ inch above the offset notch 53 on offset scale 54. Scale 55 of ruler 52 is discussed further below relative to the operation of jig 10 in cutting blind dadoes 206.

Having thus described the elements and components of dado jig 10, the operation and methods of use therefore will now be discussed.

Figure 13:
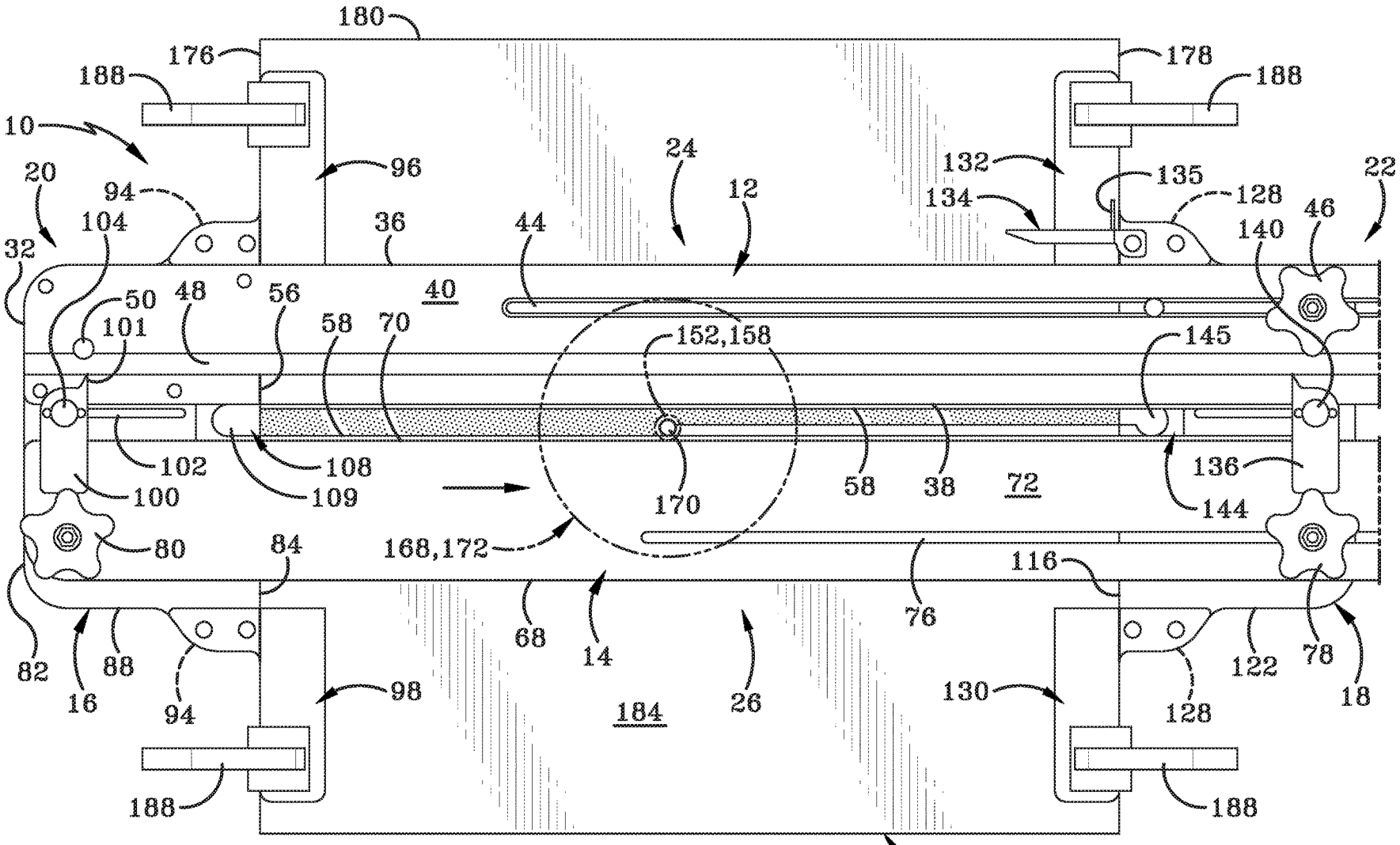
FIG. 13 (FIG. 13) is an overhead plan operational view of a dado jig installed on a first board showing a router in the process of making a second side of a dado cut according to one aspect of the present disclosure.
Figure 14:
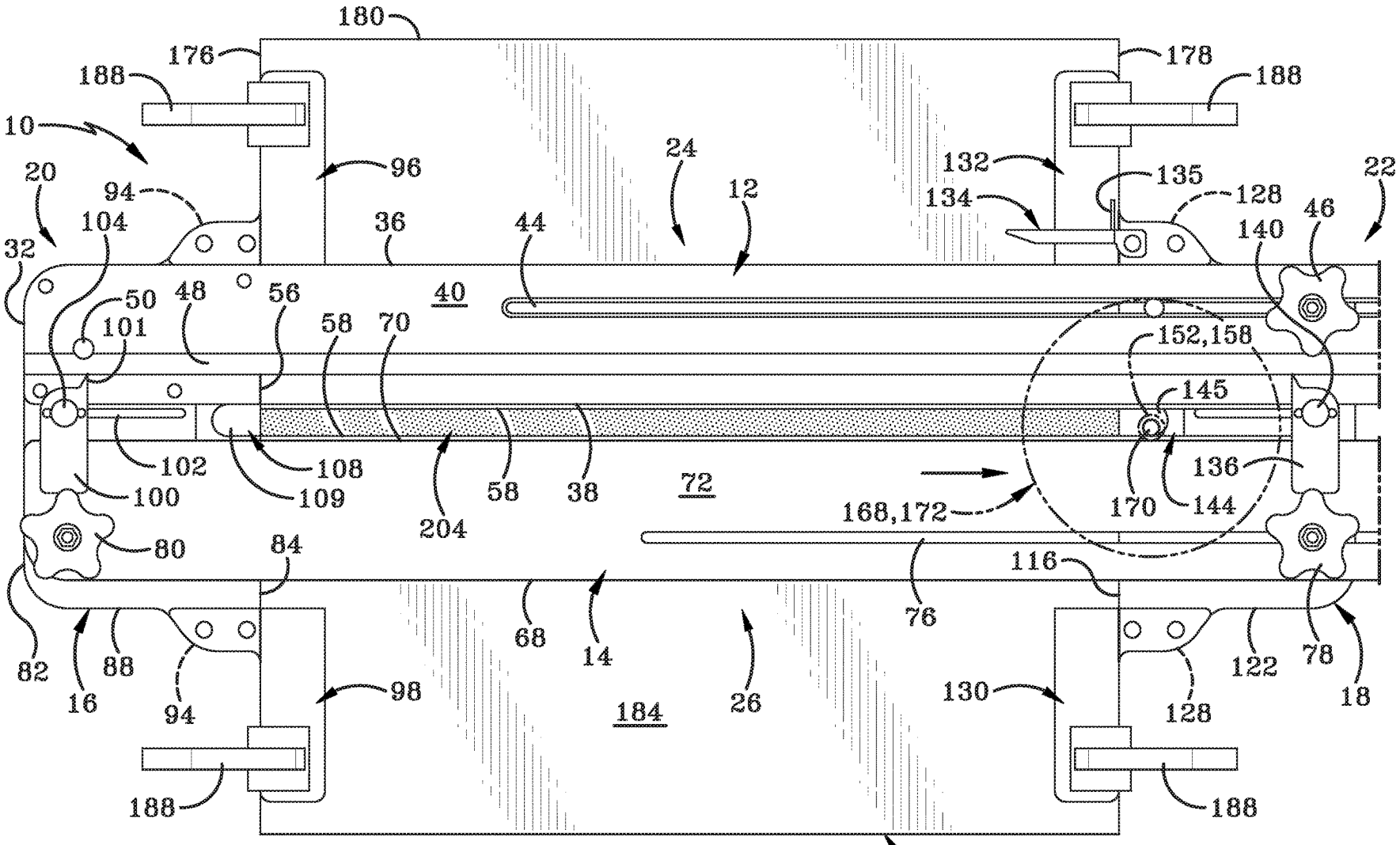
FIG. 14 (FIG. 14) is an overhead plan operational view of a dado jig installed on a first board showing a router having completed the first side of a dado cut according to one aspect of the present disclosure.
Figure 15:
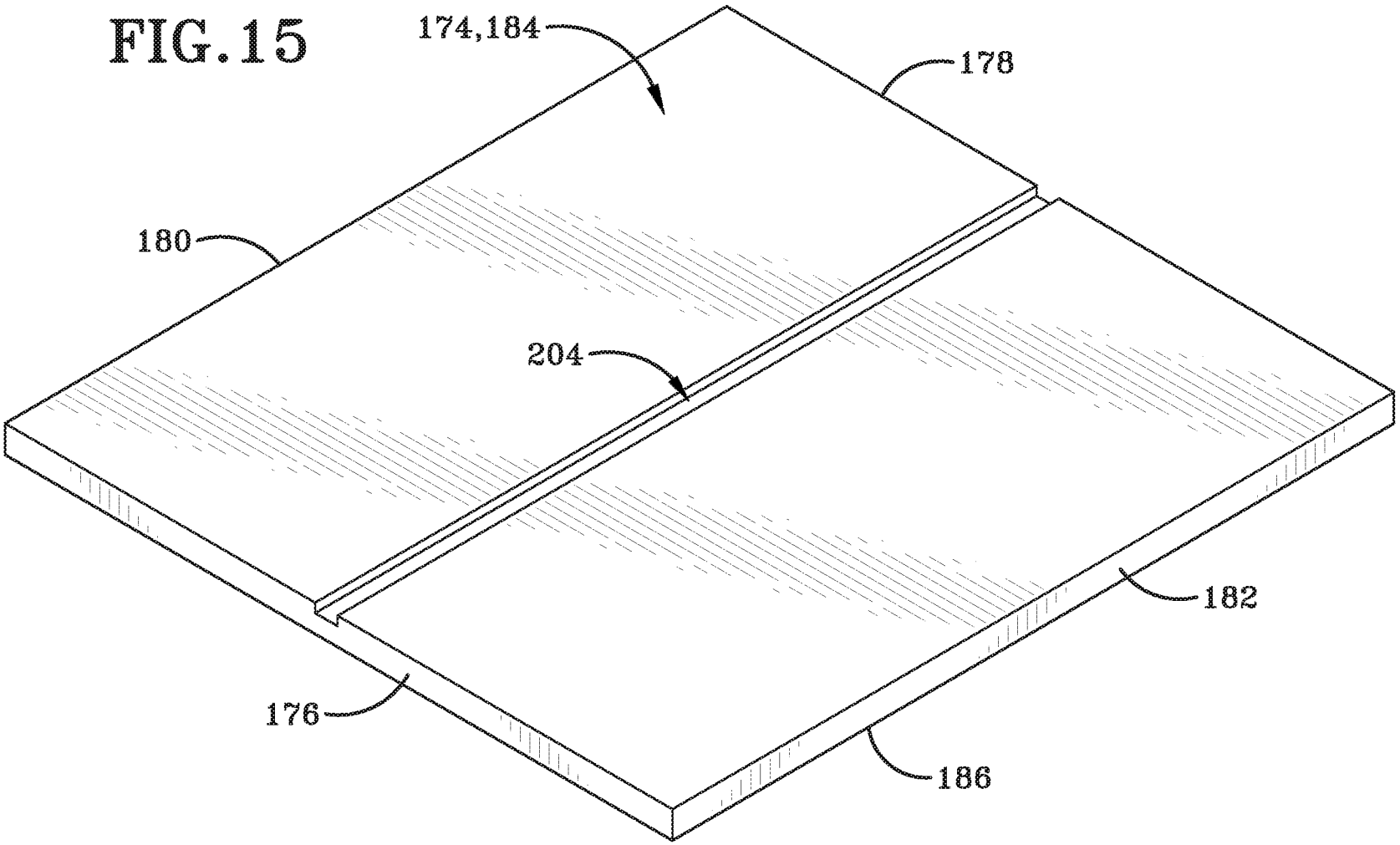
FIG. 15 (FIG. 15) is a top left perspective view of a first board with an open dado cut formed therein according to one aspect of the present disclosure.

With reference to FIGS. 5-15, the operation of dado jig 10 is depicted and discussed herein with reference to cutting an open dado 204 as seen in FIG. 15.

Prior to operating jig 10, two set-up steps must first be undertaken. First, as depicted in FIG. 5, a router bit 170 needs to be selected and set to the desired depth utilizing ruler 52. Router bit 170 may be any desired router bit; however, as depicted and discussed herein, a straight bit is used. The specific depth of the cut may be determined on a desired basis dictated by the user's preference and the particular workpiece being created. To set the depth for router bit 170, the ruler 52 may be placed with offset notch 53 rising up and over spacer ring 158 and with offset scale 54 adjacent to router bit 170. The router bit 170 may then be adjusted using offset scale 54 to the desired depth. As shown in FIG. 5 and for purposes of this example, the depth may be set to ¼ inch. The offset notch 53 and offset scale 54 may account for the vertical thickness of jig 10 to allow for the depth of router bit 170 to be set from the surface of the workpiece rather than from the top surfaces 40, 72 of first and second rails 12, 14.

The second preoperative step is to prep the edge guides 58 to accept the specific router bit 170 chosen for use. Generally speaking, this step need only be performed once per router bit (and for any router bit of the same diameter/size) in that edge guides 58 may be trimmed by this step to allow appropriate spacing for the router bit 170 to be inserted therebetween. Accordingly, to prep the edge guides 58 once the router bit 170 is installed in router 168, jig 10 may be placed on a piece of scrap or in another suitable position to allow edge guides 58 to be cut without damaging or otherwise cutting the actual workpiece during the prepping step. Once jig 10 is placed, it may be clamped in position utilizing clamps 188 to hold one or more of the first, second, third, and/or fourth clamping pads 96, 98, 130, and/or 132 against the piece of scrap. The two-way adjustment knob 78 and horizontal adjustment knob 80 may be loosened allowing second rail 14 to move horizontally with respect to first and second end plates 16, 18. The router 168 may be placed in position atop first and second rails 12, 14 and first and second rails 12, 14 may be closed against spacer rim 158 of guide bushing 152. This may provide the proper spacing between the inner side 38 of first rail 12 and the inner side 70 of second rail 14. A separate spacer (not shown) may be provided to be placed between first and second rails 12, 14 at the opposite end of jig 10 to insure proper spacing along the entire longitudinal length of first and second rails 12, 14. Once first and second rails 12, 14 are positioned against spacer ring 158, the two-way adjustment knob 78 and horizontal adjustment knob 80 may be tightened and the additional spacer (if used) may be removed. At this point, the router 168 may be powered on and the router bit 170 may be moved into the edge guides 58 to trim them to the appropriate width to provide proper clearance for router bit 170 for further use in cutting dadoes as described below.

Once the router bit 170 depth is set and the edge guides 58 are prepped for the specific sized router bit 170 being used, jig 10 is now ready for use in cutting exact width dadoes. Accordingly, first described herein is the operation of jig 10 for cutting an open dado 204 as depicted in FIG. 15. Once the operation of jig 10 is discussed fully with regards to an open dado 204, additional operation for cutting blind dadoes 206 (FIG. 18) will be described.

The processes described herein will be discussed utilizing a first board 174 and a second board 190 to cut a single dado. However, it will be understood that a plurality of boards may be used to cut multiple dadoes depending upon the desired end product. The operation of jig 10 would be the same for each dado recognizing that the jig 10 would be moved to the appropriate and desired position for each dado to be cut.

Figure 6:
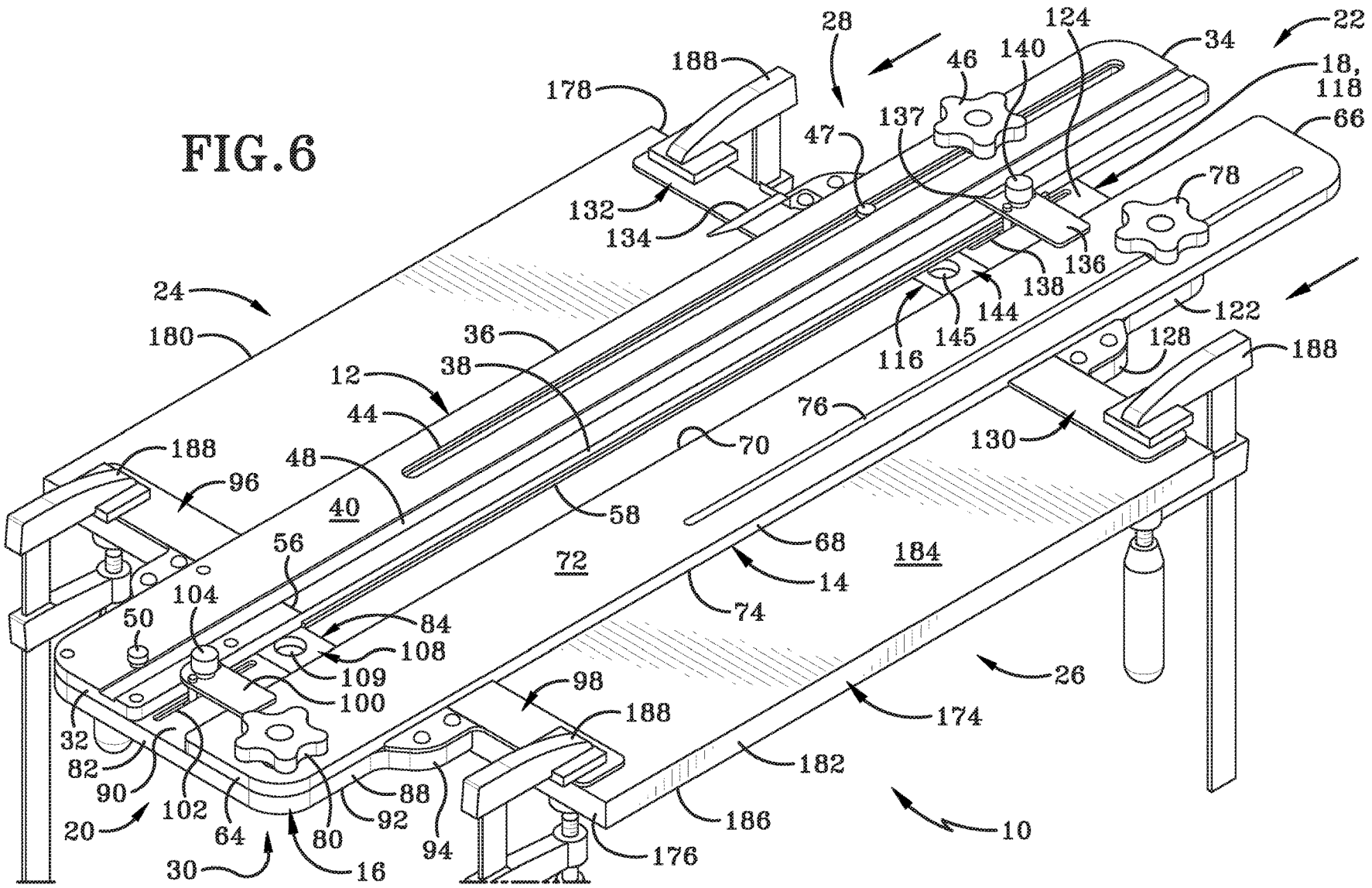
FIG. 6 (FIG. 6) is a top left perspective operational view of a dado jig installed on a first board according to one aspect of the present disclosure.

With reference now to FIG. 6, jig 10 may be placed in an appropriate position on a first board 174 having a first end 176 spaced longitudinally apart from a second end 178, a first side 180 spaced transversely apart from a second side 182, and a top face 184 spaced vertically apart from a bottom face 186 and defining the thickness of first board 174 therebetween. The jig 10 may be placed so that the longitudinal length L1 of jig 10 may extend in the longitudinal direction across first board 174. First end plate 16, or more specifically, the planar surface defined by second end 84 of first end plate 16 may be abutted against first end 176 of first board 174. The fixed corner formed between first end plate 18 and first rail 12 may create a 90° fence which may keep the jig 10 perpendicular to first edge 176 without the need for a separate square to set up jig 10 in the appropriate position. First end 176 may then be clamped in place with second end 84 of first end plate 16 abutted against first end 176 of first board 174 via first and second clamping pads 96, 98 which may extend transversely across the top face 184 of first board 174 and may be clamped thereto utilizing standard woodworking clamps 188 or any other suitable clamping device.

Next, the longitudinal adjustment knob 46 and two-way adjustment knob 78 may be loosened to allow movement of second end plate 18 relative to first end plate 16 and first and second rails 12, 14 to accommodate the longitudinal width of first board 174. If movement of second end plate 18 and/or second rail 14 is impeded by first and/or second stop members 100, 136, the first stop member thumb screw 104 and/or second stop member thumb screw 140 may be loosened to further allow unimpeded movement of second end plate 18 and/or second rail 14. Second end plate 18 may be moved longitudinally towards first end plate 16 to abut the planar surface defined by first end 116 of second end plate 18 against second end 178 of first board 174. Once second end plate 18 is in position with first end 116 abutting the second end 178 of first board 174, longitudinal adjustment knob 46 may be tightened to secure second end plate 18 in position before clamping second end plate 18 and jig 10 against the first board 174 utilizing third and fourth clamping pads 130, 132 and clamps 188 or other suitable attachment device. Jig 10 is now properly positioned with the longitudinal adjustment made to accommodate the longitudinal width of first board 174. In this position, the planar surfaces defined by second end 84 of first end plate 16 and first end 116 of second end plate 18 are abutted against the first and second ends 176, 178 of first board 174. In this position, the first and second clearance blocks 108, 144 are likewise abutted against the first and second ends 176, 178 of first board 174 and aligned with where the open dado 204 will be cut.

Once the longitudinal length of jig 10 has been adjusted and jig 10 has been clamped to first board 174 via first, second, third, and/or fourth clamping pads 96, 98, 130, and/or 132 and clamps 188, a second board 190 may be used to set the horizontal width of jig 10. As with first board 174, second board 190 may have a first end 192 spaced longitudinally apart from a second end 194, a first side 196 spaced transversely apart from a second side 198, and a top face 200 spaced vertically apart from a bottom face 202 and defining the thickness of second board 190 therebetween.

Figure 7:
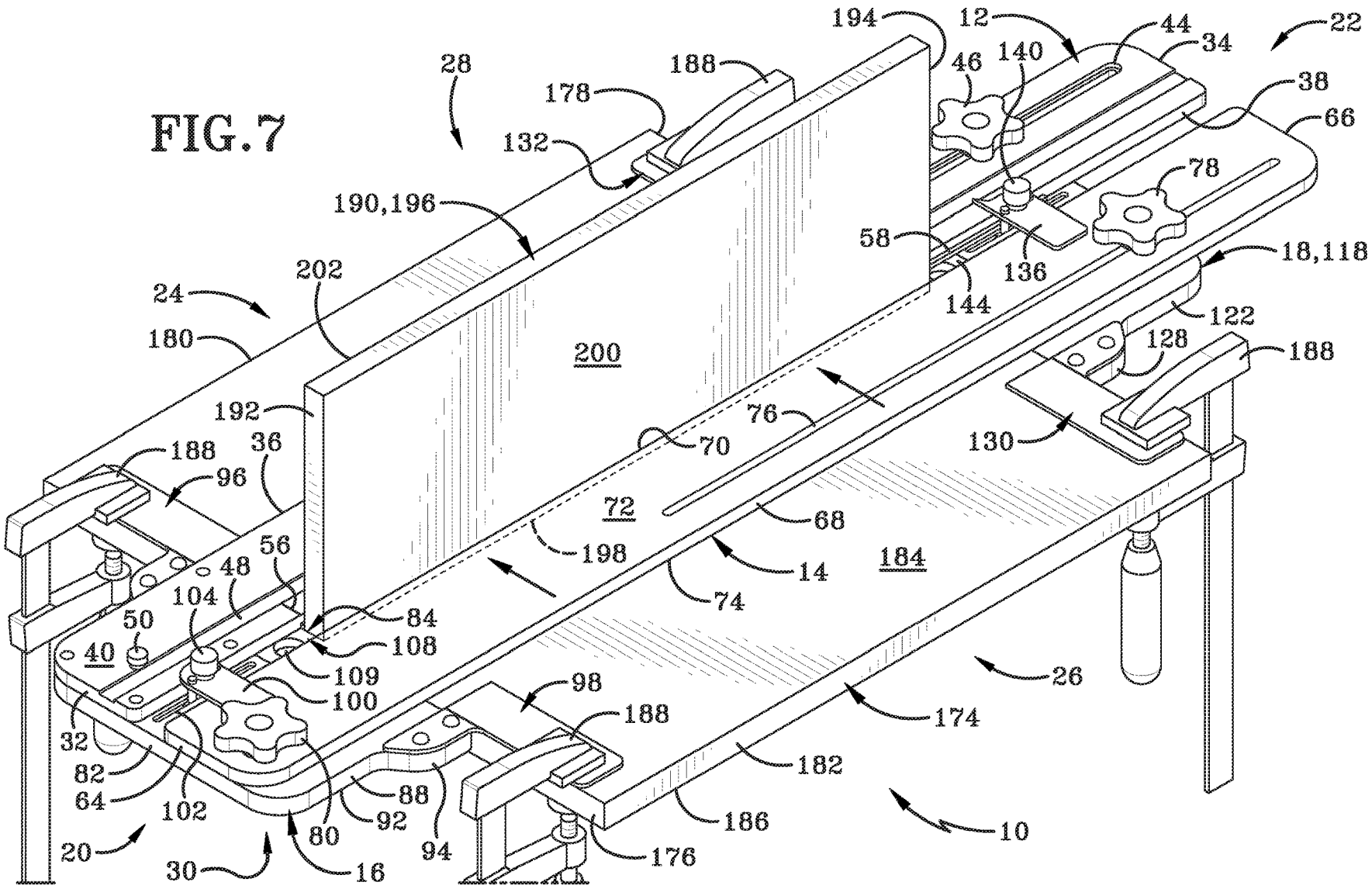
FIG. 7 (FIG. 7) is a top left perspective operational view of a dado jig installed on a first board with a second board inserted therein according to one aspect of the present disclosure.

As seen best in FIG. 7, second board 190 may inserted between first and second rails 12, 14, or more specifically between edge guides 58 of first and second rails 12, 14, and oriented perpendicularly to first board 174 such that one of the first or second sides 196, 198 of second board 190 may be in contact with the top face 184 of first board 174. As the open dado 204 is to be cut into the top face 184 of first board 174 along the longitudinal length between first end 176 and second end 178 thereof, second board 190 should be oriented with first end 192 of second board 190 towards first end 176 of first board 174 and second end 194 of second board 190 towards second end 178 of first board 174. This positional relationship between first board 174 and second board 190 allows jig 10 to be positioned to properly cut the open dado 204.

Once second board 190 is placed between edge guides 58 of first and second rails 12, 14, second rail 14 may be moved transversely or horizontally in the direction of the arrows indicated in FIG. 7 to tightly clamp edge guides 58 against the top and bottom faces 200, 202 of second board 190. Now that second board 190 is properly positioned with edge guides 58 tightly held against top and bottom faces 200, 202 thereof, horizontal adjustment knob 80 and two-way adjustment knob 78 may be tightened to secure second rail 14 in position and second board 190 may be removed from between first and second rails 12, 14 of jig 10.

Figure 8:
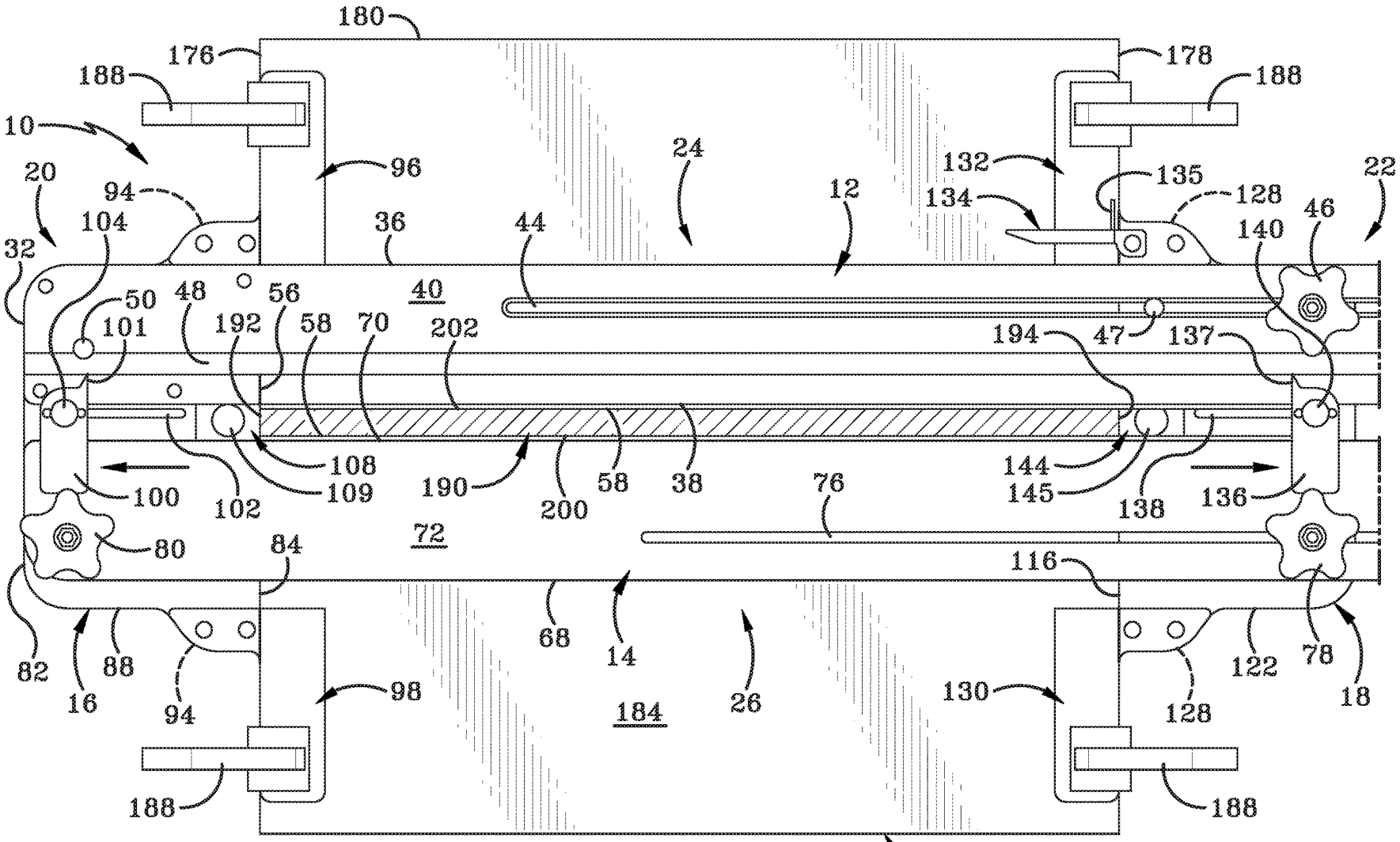
FIG. 8 (FIG. 8) is an overhead plan operational view of a dado jig installed on a first board according to one aspect of the present disclosure.

With reference to FIG. 8, with second board 190 removed from between edge guides 58 of first and second rails 12, 14, the area to be cut that will become the open dado 204 can be seen through jig 10 and is indicated in FIG. 8 with diagonal crosshatching between the edge guides 58. At this point, once second board 190 has been removed from between the first and second rails 12, 14, stop members 100, 136 may be moved to their farthest longitudinal positions towards first and second ends 20, 22 of jig 10 to keep stop members 100, 136 from interfering with operation of the router 168 when cutting open dadoes 204. Stop members 100, 136 may be moved by first loosening the stop member thumb screws 104, 140 and sliding the lower portions 106, 142 within the stop member adjustment slots 102, 138 to move stop members 100, 136 to their desired positions. Once in the desired positions, thumb screws 104, 140 may be tightened to secure stop members 100, 136 in place. Movement of stop members 100, 136 is best seen and indicated by the arrows in FIG. 8.

With reference to FIGS. 9-14, the actual cutting of open dado 204 is depicted and will now be discussed. As shown in these figures for purposes of clarity, particularly in FIGS. 9, 10, and 12-14 (and in FIGS. 16-17, discussed below), the router 168 and router fence 172 are indicated therein as a large circle made of a dot-dot-dash line with router bit 170 drawn in the center of the circle as a smaller circle rendered with a solid line. Guide bushing 152, and more particularly spacer ring 158 thereof, is likewise depicted towards the center of the router 168 circle as a slightly larger circle than router bit 170, but rendered in a dot-dot-dash line format. These components have been depicted as such to clearly show how the open dado 204 is being cut without obstruction.

Figure 9:
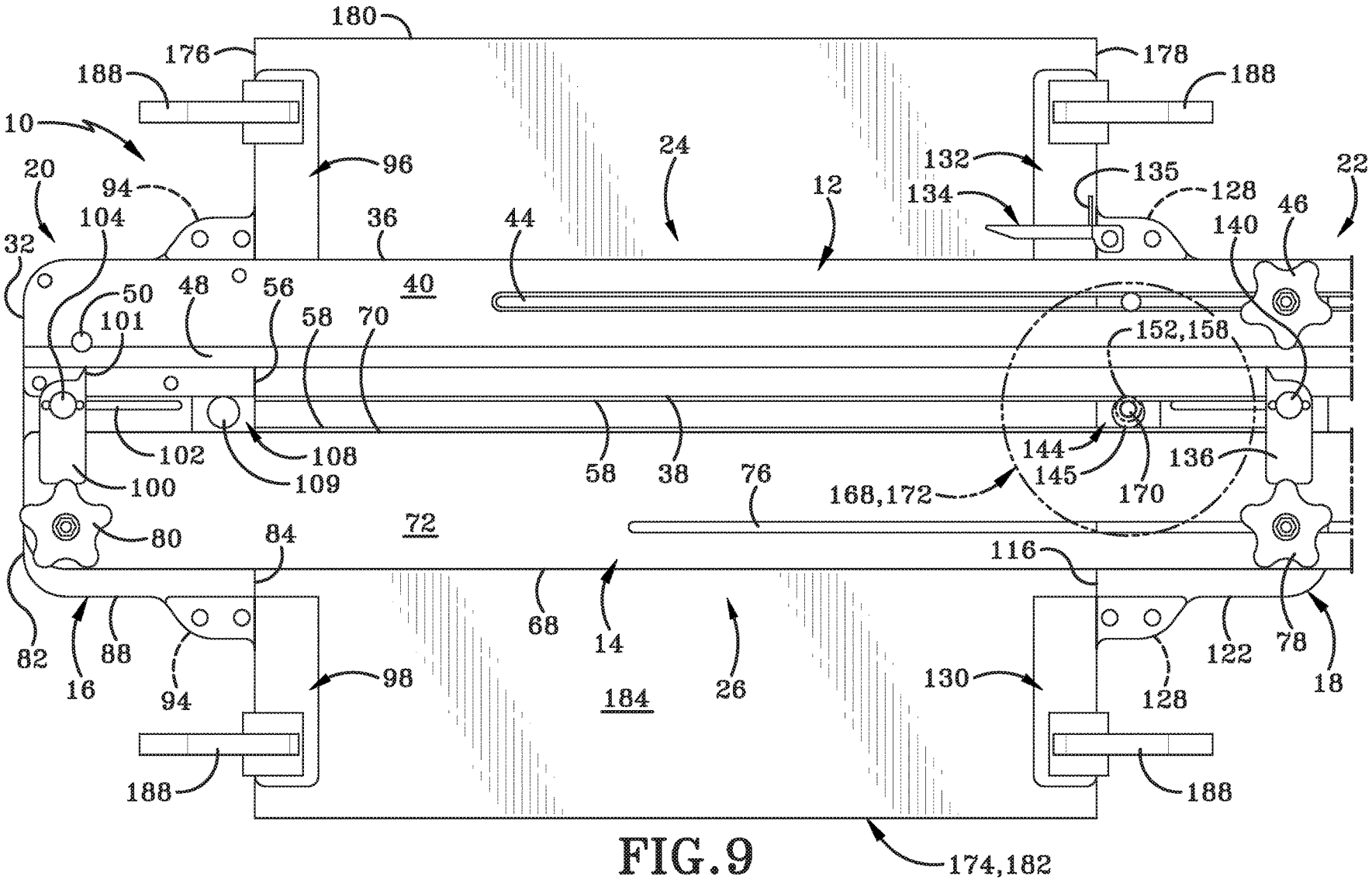
FIG. 9 (FIG. 9) is an overhead plan operational view of a dado jig installed on a first board showing a router prior to making a dado cut according to one aspect of the present disclosure.
Figure 10:
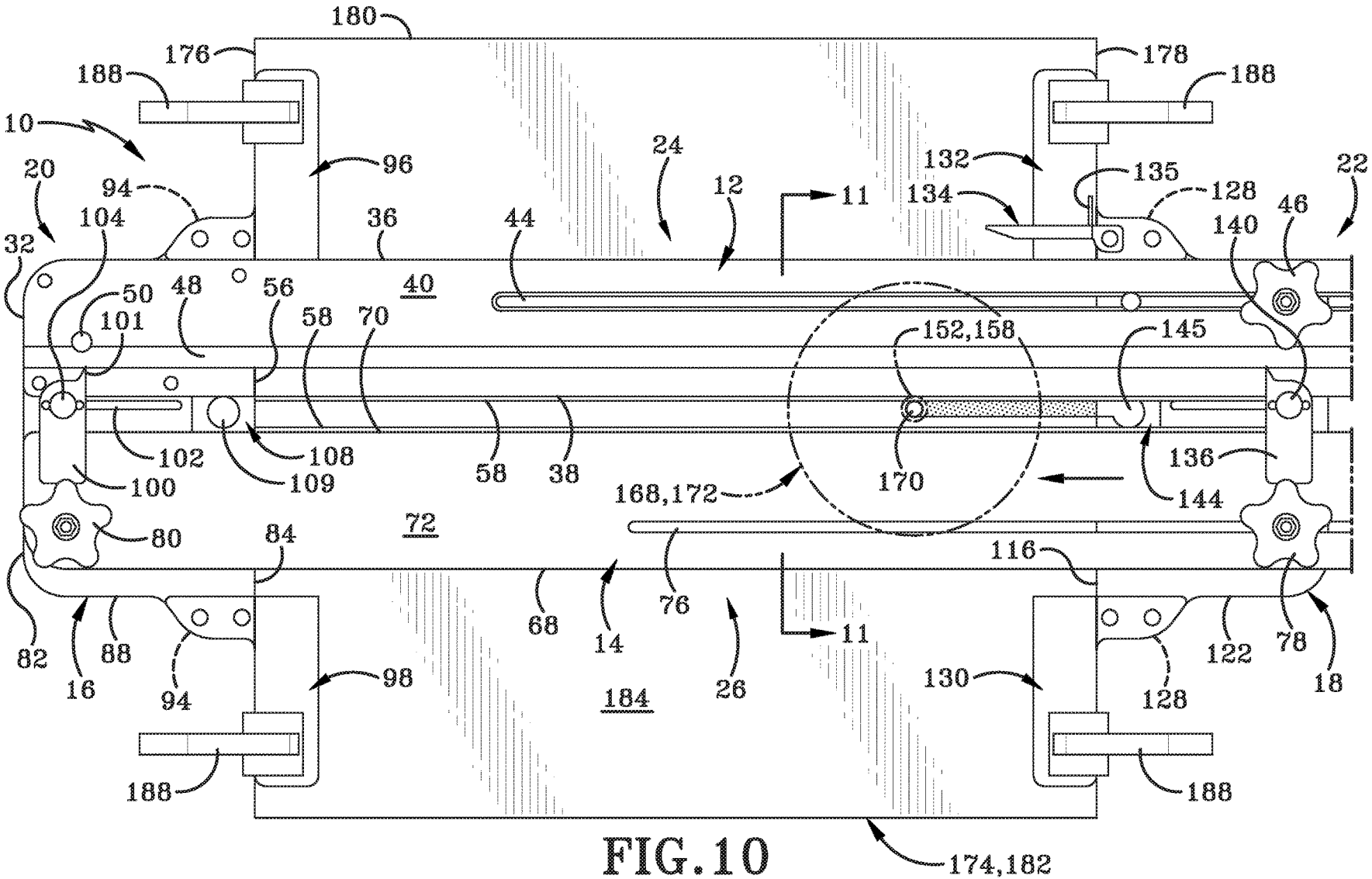
FIG. 10 (FIG. 10) is an overhead plan operational view of a dado jig installed on a first board showing a router in the process of making a first side of a dado cut according to one aspect of the present disclosure.

Accordingly, with reference to FIGS. 9-10, the router 168 may be placed atop the top surfaces 72, 90 of first and second rails 12, 14 with router bit 170 inserted into clearance hole 145 of second clearance block 144. Although depicted being cut from second end 22 towards first end 20 and therefore starting in clearance hole 145 of second clearance block 144, it will be understood that router 168 may be initially placed at first end 20 of jig 10 with router bit 170 inserted into clearance hole 109 of first clearance block 108 and open dado 204 may be cut initially from first end 20 towards second end 22 of jig 10 without discrimination. As further seen in FIG. 9, the router 168 may be placed slightly off center so that spacer ring 158 may contact the inner side 38 of first rail 12 while router bit 170 may contact the guide edge 58 of first rail 12. Router 168 may be then powered on and moved along the inner side 38 of first rail 12 with router bit 170 riding along the edge guide 58 of first rail 12. Router may be moved towards first end 20 beginning the cut of open dado 204. Clearance block 144 is abutted directly against second end 178 of first board 174 to prevent splintering and/or tear-out as router bit 170 enters into the top surface 184 of first board 174 from second end 178. The area being cut and removed from top surface 184 of first board 174 is indicated by stippling showing the contrast between the uncut regions and cut regions in FIG. 10 (and FIGS. 12-14).

Figure 11:
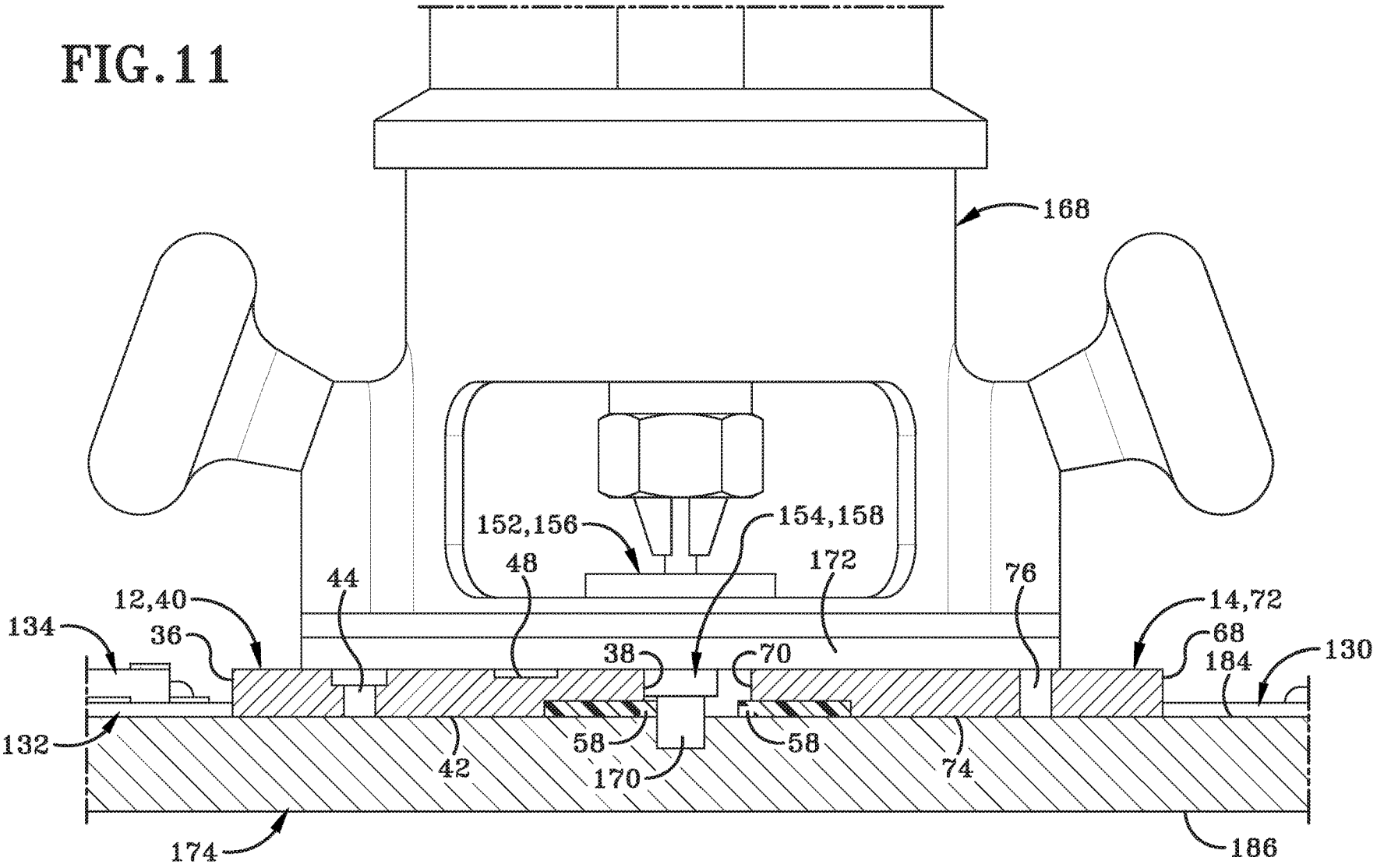
FIG. 11 (FIG. 11) is a side elevation view of router and a dado jig in use on a first board, with the dado jig and first board rendered in cross-section according to one aspect of the present disclosure.

With reference to FIG. 11, a cross-section taken along line 11-11 from FIG. 10 is shown with router 168 in operation. The partial cross-section view in FIG. 11 is provided to show the relationship between router bit 170 and spacer ring 158 with edge guide 58 of first rail 12 and inner side 38 or first rail 12, respectively. Further, the partial cross-section of FIG. 11 clearly shows space between edge guide 58 and router bit 170 and between inner side 70 of second rail 14 and spacer ring 158. This is intentional as router 168 is contemplated to be moved up one rail 12 or 14 of jig 10 to cut open dado 204 and then moved across and down the opposite rail 12 or 14 of jig 10 to finish cutting open dado 204 in two passes. This insures a tight relationship and alignment with inner sides 38, 70 of first and second rails 12, 14 and edge guides 58 to provide the exact width dado to match the thickness of second board 190.

Figure 12:
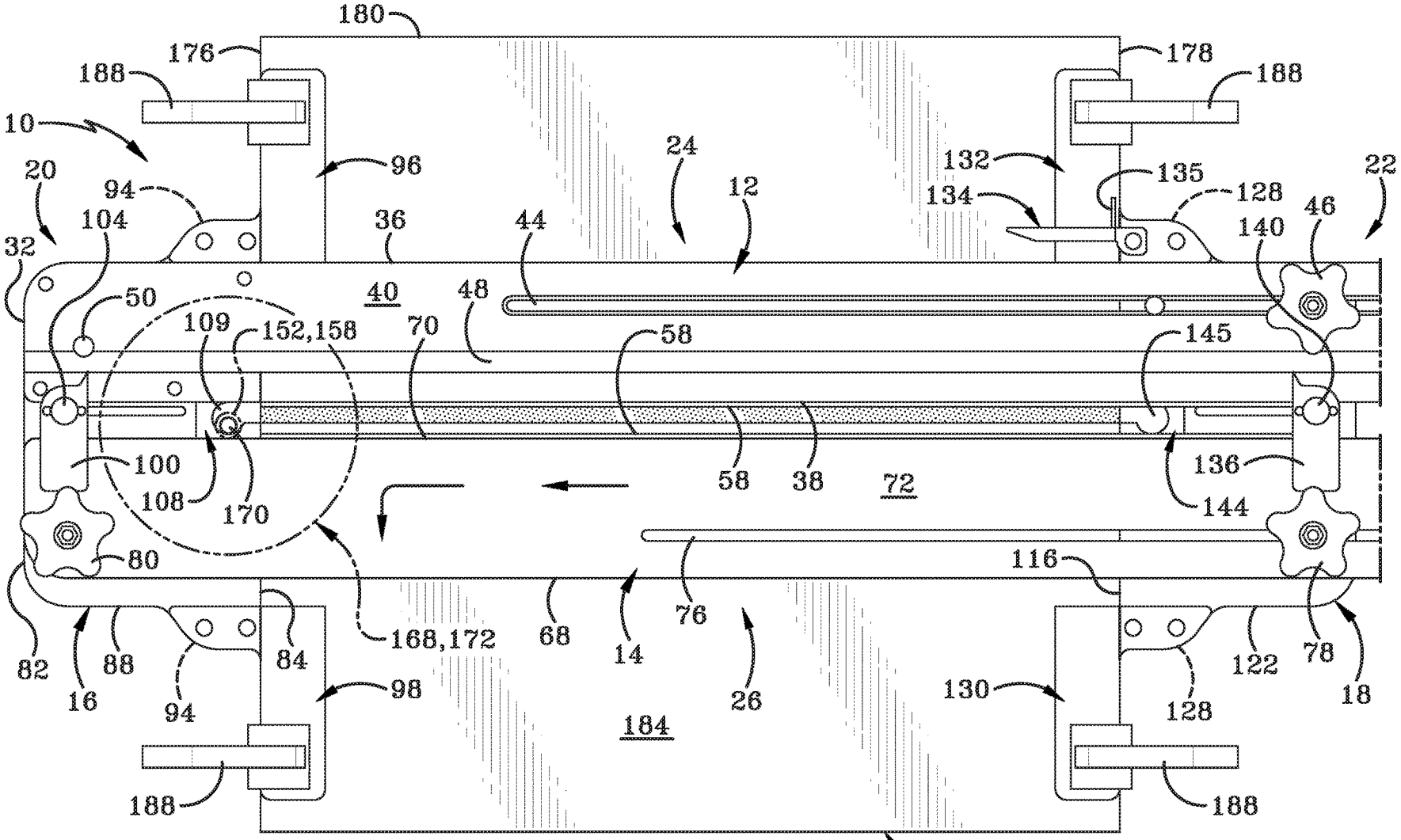
FIG. 12 (FIG. 12) is an overhead plan operational view of a dado jig installed on a first board showing a router having completed the first side of a dado cut according to one aspect of the present disclosure.

With reference to FIGS. 12-14, router 168 may complete its first pass through top surface 184 of first board 174 reaching first clearance block 108 as router bit 170 enters clearance hole 109. Router 168 may be moved transversely from a position wherein spacer ring 158 is in contact with the inner side 38 of first rail 12 to a position wherein spacer ring 158 in now in contact with the inner side 70 of second rail 14. Similarly, router bit 170 may move from edge guide 58 on first rail 12 to edge guide 58 on second rail 14. Router 168 may then be moved in the opposite direction from first end 20 towards second end 22 of jig 10 to begin cutting the second side of open dado 204, as best seen in FIG. 13.

As router 168 is moved through the top surface 184 of first board 174 and into second clearance block 144 and router bit 170 returns into clearance hole 145, the open dado 204 cut is complete and router 168 may be powered off and removed from jig 10. The presence of clearance blocks 108, 144 held tightly against first and second ends 176, 178 of first board 174 may prevent splintering and tear-out of first board 174 and may further facilitate a clean and fine finish to open dado 204, which is best seen in FIG. 15. With open dado 204 now appropriately cut, jig 10 may be removed from first board 174.

If additional open dadoes 204 are desired to be cut within first board 174, jig 10 may be removed from the position where the first dado 204 was cut and replaced in a second position to cut an additional dado 204 according to the same methods. If the dadoes 204, or more particularly the additional boards, have the exact same thickness as second board 190, an abbreviated method may be followed wherein additional horizontal width adjustments of jig 10 may be unnecessary as jig 10 may already be set for boards of exact or similar thickness. Accordingly, where second board 190 is cut from the same stock piece as additional boards, jig 10 may be set up once and rapidly moved between positions to cut multiple dadoes 204 without adjusting the horizontal width W2 between edge guides 58 and only minimally adjusting the longitudinal length L2 to allow movement across top surface 184 of first board 174 before replacing jig 10 in the new location. Alternatively, if no more open dadoes 204 are desired, jig 10 may be unclamped and removed from first board 174 and second board 190 may be appropriately inserted and/or secured within the open dado 204 according to known woodworking methods.

Figure 16:
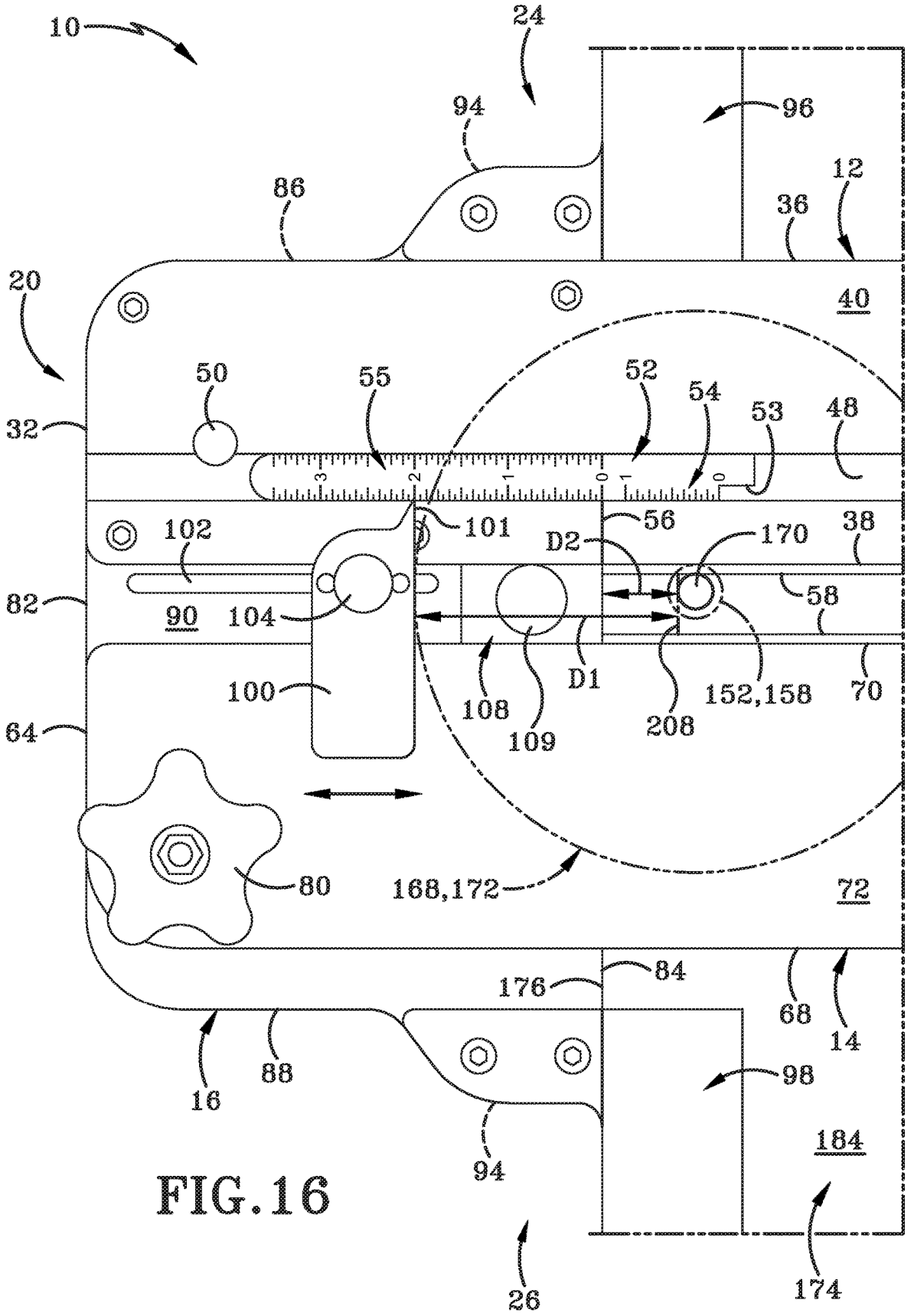
FIG. 16 (FIG. 16) is a top plan operational view of a first end of a dado jig according to one aspect of the present disclosure.
Figure 18:
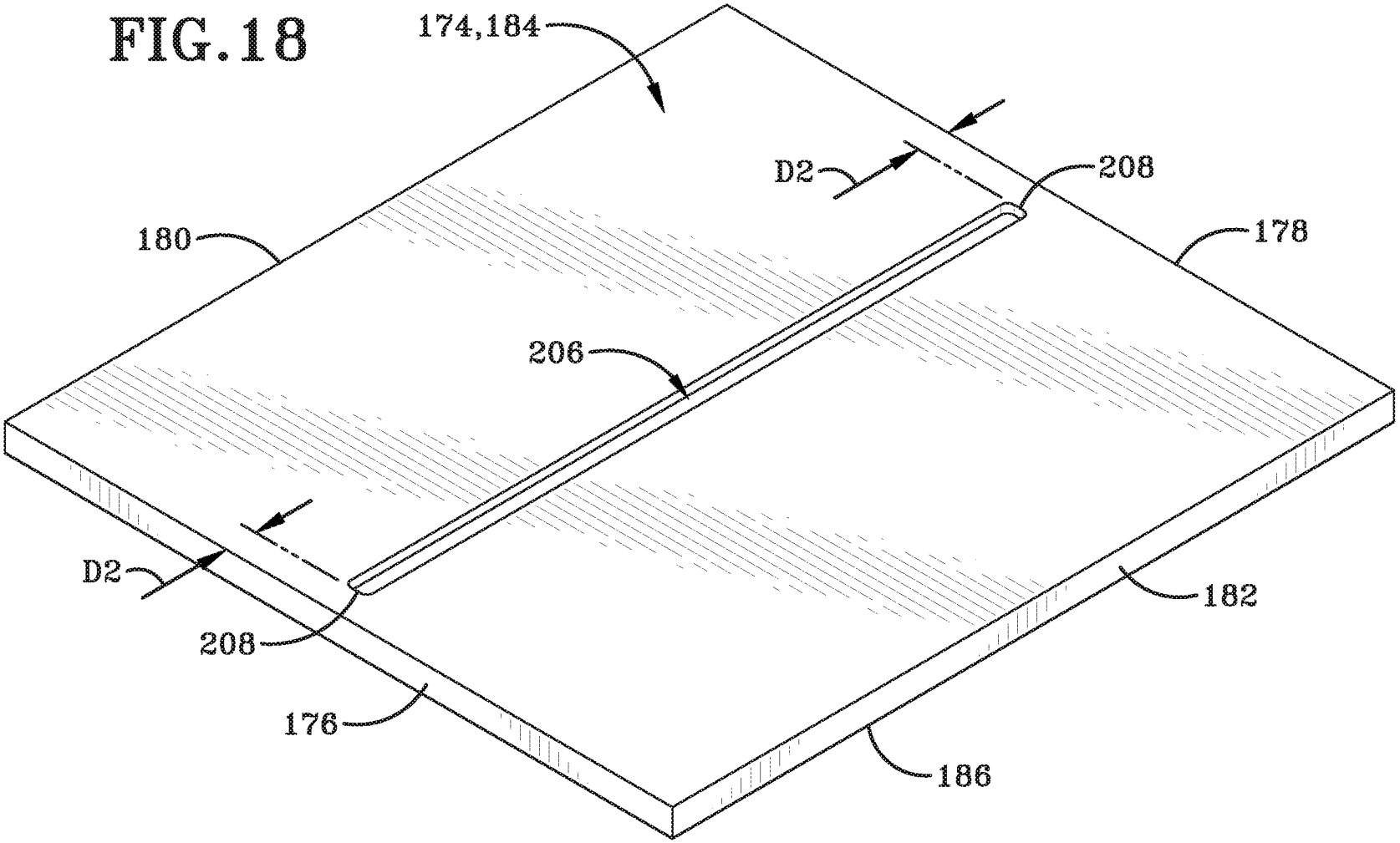
FIG. 18 (FIG. 18) is a top left perspective view of a first board with a blind dado cut formed therein according to one aspect of the present disclosure.

With reference now to FIGS. 16-18, a method for cutting blind dadoes 206 (best seen in FIG. 18) will now be discussed. A blind dado 206 is one where the cuts into first board 174 are not seen when viewed from one or both of first and/or second ends 176, 178. Specifically, the blind dado 206 has terminal ends 208 that do not reach the first and second ends 176, 178 of first board 174. Jig 10 may be utilized to cut blind dadoes 206 using a very similar or nearly exact method as used for cutting open dadoes 204 discussed above; however, cutting blind dadoes 206 involves the utilization of first and second stop members 100, 136, as well as ruler 52.

To properly utilize jig 10 to cut blind dadoes 206, two pieces of information must be known. First, the operator must know the distance from the router bit 170 to the outer edge of the router fence 172. This distance is not standard as different brands and types of routers 168 may have different size of fences 172. This distance may alternatively be measured or indicated as the distance between the inner edge 161 of the end surface 159 of spacer ring 158 to the router fence 172. This distance is best shown in FIG. 16 as distance D1.

The second piece of information needed to properly set up jig 10 for cutting blind dadoes 206 is the desired distance between the ends 176 and/or 178 of first board 174 and the terminal ends 208 of the blind dado 206. This distance is indicated as distance D2 as best seen in FIGS. 16 and 18. While it is discussed and contemplated that distance D2 will be the same or identical between first and second ends 176, 178 of first board 174, depending upon the desired result, jig 10 may be set up to allow different distances between terminal ends 208 of blind dadoes 206. For example, where a workpiece might be made having a backing thereon, an open dado 204 may be cut at one end, e.g. second end 178, of first board 174 with a blind dado 206 cut at first end 176. In this example, the open dado 204 will be hidden from view by the backing while the blind dado 206 will be presented to the front view of the workpiece. It will therefore be understood that any combination of open and blind dadoes 204, 206 may easily and quickly cut utilizing jig 10 by simple adjustments or adaptations of the methods provided herein.

To properly set jig 10 for cutting blind dadoes 206 and armed with both the distance D1 between the router bit 170 and the router fence 172 and distance D2 between the desired terminal end 208 and the ends 176, and/or 178 of first board 174, jig 10 may be set to stop the router 168 at the desired position to cut the blind dado 206. Specifically, with reference to FIG. 16, first end 176 may be adjusted by first aligning ruler 52 such that the zero measurement of scale 55 marking is aligned with the reference line 56 on top surface 40 of first rail 12.

Next, the stop member thumb screw 104 for first stop member 100 may be loosened and first stop member 100 may be moved to the desired position by aligning stop member pointer 101 with the appropriate measurement increment on scale 55 of ruler 52. For example, where distance D1 is equal to 2½ inches and the desired distance D2 between terminal end 208 and first end 176 of first board 174 is ½ inch, stop member 100 may be placed such that stop member pointer 101 is aligned with the 2-inch mark on scale 55 of ruler 52, as depicted in FIG. 16. This position will cause router fence 172 to impact stop member 100 with the router bit 170 stopping ½ inch short of the first end 176 of first board 174.

With reference to FIG. 17, setting the second end 22 of jig 10 for a similar stop may be accomplished using scale 55 of ruler 52 and pivoting reference member 134. First, ruler 52 may be slid along ruler channel 48 to the second end 22 of jig 10. Next, the pivoting reference marker 134 may be pivoted from the first position to the second position wherein it extends over and across top surface 40 of first rail 12. As seen in FIG. 17, pivoting reference marker 134 extends over the space occupied by ruler channel 48 and ultimately over ruler 52 to provide a reference point aligned with the second end 178 of first board 174. When ruler 52 is merely slid to second end 22 of jig 10, the measurement marking positions on scale 55 of ruler 52 may be reversed. For example, again using D1 as 2½ inches and D2 as ½ inch, where reference line 56 was aligned with the zero point on scale 55 and stop member pointer 101 was aligned at 2 inches on scale 55, the opposite may be utilized at second end 22 such that pivoting reference marker 134 may be aligned at 2 inches and stop member pointer 137 may be aligned at the zero inch mark on scale 55 of ruler 52. This reversed measurement will result in router fence 172 contacting second stop member 136 with router bit 170 stopping ½ inch short of reaching second end 178 of first board 174.

Alternatively, ruler 52 may be removed from ruler channel 48 by loosening ruler thumb screw 50 and sliding ruler 52 out of the end of ruler channel 48 at first end 32 of first rail 12, rotating ruler 180° to place scale 55 in the opposite orientation and reinserting ruler 52 into ruler channel 48 at first end 32 of first rail 12 before sliding ruler 52 to second end 22 of jig 10.

With the first and second stop members 100, 136 in the desired positions, router 168 may again be placed on the top surfaces 40, 72 of first and second rails 12, 14 and may be plunged into the top face 184 of first board 174. As router bit 170 is not being moved through the end plane of first and second ends 176, 178 of first board 174, splintering and/or tear-out will be minimal or eliminated, therefore, not requiring the use of clearance blocks 108 and/or 144. Router 168 may then be moved laterally between first and second ends 20, 22 of jig 10 while maintaining contact with the inner side 38 or 70 of first or second rail 12 or 14 by spacer ring 158 and with edge guides 58 of first or second rails 12 or 14 by router bit 170.

As router 168 is moved the length of the jig 10, router fence 172 will contact the stop member 100 or 136 at the opposite end 20 or 22 of jig 10, and router 168 will not be able to progress further. Router 168 may then be moved transversely to contact the inner side 38 or 70 of the opposite rail 12, 14 with spacer ring 158 and the opposite edge guard 58 with router bit 170. Router 168 may then be moved in the opposite direction between first and second ends 20 and 22 of jig 10 until the router fence 172 contacts the opposite stop member 100 or 136. At this point, the blind dado 206 is complete and router 168 may be switched off and removed from jig 10.

As with open dadoes 204, if additional blind dadoes 206 are desired, jig 10 may be moved to the new position to cut additional blind dadoes 206. Alternatively, if no more blind dadoes 206 are desired, jig 10 may be unclamped and removed from first board 174 and second board 190 may be appropriately inserted and/or secured within the blind dado 206 according to known woodworking methods.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A jig for cutting dadoes comprising:

a first rail having a first end orthogonally fixed to a first end plate and a second end longitudinally spaced apart from the first end and defining the longitudinal length of the first rail therebetween;

a second rail having a first end movably connected to the first end plate and a second end longitudinally spaced apart from the first end and defining the longitudinal length of the second rail therebetween, the second rail being movable relative to the first rail in a transverse direction orthogonal to longitudinal length of the first and second rails;

a second end plate moveably connected to the second end of the first rail and the second end of the second rail, the second end plate being movable relative to the first end plate along the longitudinal length of the first and second rails;

a first edge guide connected to the first rail;

a second edge guide connected to the second rail, the first and second edge guides operable to guide a router bit for cutting a dado in a workpiece; and a ruler removably attached to the first rail via a ruler channel defined therein.

2. The jig of claim 1 further comprising:

a first longitudinal adjustment slot defined in the first rail and extending from adjacent the second end of the first rail towards the first end of the first rail; and a second longitudinal adjustment slot defined in the second rail and extending from adjacent the second end of the second rail towards the first end of the second rail.

3. The jig of claim 2 further comprising:

an alignment screw and a first adjustment knob disposed through the first longitudinal adjustment slot; and a second adjustment knob disposed through the second longitudinal adjustment slot.

4. The jig of claim 3 the second end plate is movable to a plurality of positions between a first position, wherein a second end of the second end plate is aligned with the second ends of the first rail and the second rail, and a second position, wherein the alignment screw contacts the end of the first longitudinal adjustment slot closest to the first end of the first longitudinal adjustment slot.

5. The jig of claim 1 wherein the fixed intersection between the first rail and the first end plate further comprises:

a 90° fence.

6. The jig of claim 1 further comprising:

a first stop member disposed within a first stop member adjustment slot defined through the first end plate; and a second stop member disposed within a second stop member adjustment slot defined through the second end plate.

7. The jig of claim 1 further comprising;

a first horizontal adjustment slot defined through the first end plate and operational to interact with a third adjustment knob for the transverse movement of the first end of the second rail relative to the first end of the first rail; and a second horizontal adjustment slot defined through the second end plate and operational to interact with a second adjustment knob for the transverse movement of the second end of the second rail relative to the second end of the first rail.

8. The jig of claim 1 wherein the ruler further comprises:

an offset notch defined therein and sized to equal a vertical thickness of the jig; and an offset scale marked on the ruler operable for use in measuring the depth of a router bit relative to the surface of the workpiece and the vertical thickness of the jig.

9. A method of cutting dadoes comprising:

aligning a first end plate of a dado jig against a first end of a first board and securing the first end plate thereto;

aligning a second end plate of the dado jig against a second end of the first board longitudinally opposite the first end plate and securing the second end plate thereto;

positioning a second board orthogonal to the first board with a side of the second board between a first rail extending longitudinally between the first end plate and the second end plate of the dado jig and a second rail extending longitudinally between the first end plate and the second end plate of the dado jig;

moving the second rail transversely relative to the first rail to contact a first face of the second board with the first rail and a second face of the second board with the second rail;

securing the second rail in position relative to the first rail;

removing the second board from between the first and second rails;

placing a ruler having an offset notch equal to the vertical thickness of the dado jig and with an offset scale marked on the ruler next to a router bit installed within a router;

setting a depth of the router bit to a desired depth of the dado to be cut relative to the offset scale to account for the vertical thickness of the dado jig; and cutting a dado in the first board between the first and second rails of the dado jig.

10. The method of claim 9 wherein aligning the second end plate further comprises:

moving the second end plate longitudinally relative to the first end plate to equal the longitudinal length of the first board until the second end plate contacts the second end of the first board; and securing the second end plate in position relative to the first end plate and the first board.

11. The method of claim 9 wherein moving the second rail transversely relative to the first rail further comprises:

moving the second rail transversely relative to the first rail to contact the first face of the second board with a first edge guide on the first rail and a second face of the second board with a second edge guide on the second rail.

12. The method of claim 11 further comprising:

sizing the first and second edge guides to fit a router bit therebetween prior to aligning the first end plate and second end plate with the first board and securing the endplates thereto.

13. The method of claim 9 wherein cutting the dado in the first board further comprises:

cutting an open dado in the first board.

14. The method of claim 9 further comprising:

setting a first stop member on the first end plate to define a first terminal end of the dado; and setting a second stop member on the second end plate to define a second terminal end of the dado;

wherein setting the first and second stop members is accomplished prior to cutting the dado in the first board.

15. The method of claim 14 wherein cutting the dado in the first board further comprises:

cutting a blind dado in the first board.

16. The method of claim 14 wherein setting the first stop member further comprises:

aligning a first measurement marking of a ruler at a first end of the first rail adjacent the first end plate with a reference line indicating the position of the first end of the first board;

aligning a pointer of the first stop member with a second measurement marking on the ruler; and securing the first stop member in position relative to the ruler.

17. The method of claim 16 wherein setting the second stop member further comprises:

sliding the ruler to a second end of the first rail adjacent the second end plate;

rotating a reference marker across the first rail;

aligning a third measurement marking of the ruler with the reference marker;

aligning a pointer of the second stop member with a fourth measurement marking on the ruler; and securing the second stop member in position relative to the ruler.

* * * * *